US006832825B1

(12) United States Patent
Nishikori et al.

(10) Patent No.: US 6,832,825 B1
(45) Date of Patent: Dec. 21, 2004

(54) TEST PATTERN PRINTING METHOD, INFORMATION PROCESSING APPARATUS, PRINTING APPARATUS AND DENSITY VARIATION CORRECTION METHOD

(75) Inventors: Hitoshi Nishikori, Inagi (JP); Naoji Otsuka, Yokohama (JP); Hitoshi Sugimoto, Yokohama (JP); Kiichiro Takahashi, Kawasaki (JP); Osamu Iwasaki, Tokyo (JP); Kaneji Yamada, Tokyo (JP); Minoru Teshigawara, Yokohama (JP); Takeshi Yazawa, Kawasaki (JP); Toshiyuki Chikuma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 678 days.

(21) Appl. No.: 09/679,343

(22) Filed: Oct. 4, 2000

(30) Foreign Application Priority Data

Oct. 5, 1999 (JP) ..... 11-284936
Oct. 5, 1999 (JP) ..... 11-284937

(51) Int. Cl.[7] ..... B41J 2/01
(52) U.S. Cl. ..... 347/19; 400/74
(58) Field of Search ..... 400/74; 347/19, 347/12, 37; 358/504, 406

(56) References Cited

U.S. PATENT DOCUMENTS 4,313,124 A 1/1982 Hara ..... 346/140
4,345,262 A 8/1982 Shirato et al. ..... 346/140
4,459,600 A 7/1984 Sato et al. ..... 346/140
4,463,359 A 7/1984 Ayata et al. ..... 346/1.1
4,558,333 A 12/1985 Sugitani et al. ..... 346/140
4,608,577 A 8/1986 Hori ..... 346/140
4,723,129 A 2/1988 Endo et al. ..... 346/1.1
4,740,796 A 4/1988 Endo et al. ..... 346/1.1
5,353,052 A * 10/1994 Suzuki et al. ..... 347/19
5,528,270 A 6/1996 Tajika et al. ..... 347/19
6,361,139 B1 * 3/2002 Gomez et al. ..... 347/19

FOREIGN PATENT DOCUMENTS

JP 54-056847 5/1979
JP 59-123670 7/1984
JP 59-31949 8/1984
JP 59-138461 8/1984
JP 60-071260 4/1985
JP 01-041375 2/1989
JP 05-069545 3/1993

* cited by examiner

*Primary Examiner*—Craig Hallacher
(74) *Attorney, Agent, or Firm*—Fitzpatrick, Cella, Harper & Scinto

(57) ABSTRACT

An apparatus and method capable of obtaining an output characteristic of the print unit and determining a correction value for an output density, without using an expensive scanner. To realize this, a nozzle array consisting of a plurality of nozzles provided in the print head is divided into a plurality of nozzle blocks [a] to [d] and each of patches is formed by using the nozzles of the same nozzle block allocated to the patch. The patches are printed in a size and shape that allows the densities of the patches to be optically detected by the density sensor. A test pattern comprising these patches is measured by the density sensor to make a density correction for each nozzle of the print head.

42 Claims, 33 Drawing Sheets

| PATCH | SCAN | NOZZLE | CORRECTION VALUE |
|---|---|---|---|
| (A) | FORWARD SCAN | 1~4 | 1.0 |
| (B) | FORWARD SCAN | 5~8 | 0.9 |
| (C) | FORWARD SCAN | 9~12 | 0.9 |
| (D) | FORWARD SCAN | 13~16 | 0.9 |
| (E) | BACKWARD SCAN | 1~4 | 0.8 |
| (F) | BACKWARD SCAN | 5~8 | 0.8 |
| (G) | BACKWARD SCAN | 9~12 | 0.8 |
| (H) | BACKWARD SCAN | 13~16 | 0.9 |

FIG.12

| PATCH | PRINTING SCAN | NOZZLE | CORRECTION VALUE |
|---|---|---|---|
| [A] | FORWARD SCAN | 1,2 | 1.1 |
| [B] | FORWARD SCAN | 3~6 | 1.0 |
| [C] | FORWARD SCAN | 7~10 | 1.0 |
| [D] | FORWARD SCAN | 11~14 | 0.9 |
| [E] | FORWARD SCAN | 15,16 | 1.0 |

FIG.18

25% PATTERN

50% PATTERN

75% PATTERN

100% PATTERN

| PATCH | SCAN | NOZZLE | CORRECTION VALUE |
|---|---|---|---|
| (A) | FORWARD SCAN | 1~4 | 0.9 |
| (B) | FORWARD SCAN | 5~8 | 0.7 |
| (C) | FORWARD SCAN | 9~12 | 1.0 |
| (D) | FORWARD SCAN | 13~16 | 0.8 |

FIG.36

TEST PATTERN PRINTING METHOD, INFORMATION PROCESSING APPARATUS, PRINTING APPARATUS AND DENSITY VARIATION CORRECTION METHOD

This application is based on Japanese Patent application Nos. 11-284936 (1999) and 11-284937 (1999) both filed Oct. 5, 1999 in Japan, the content of which is incorporated hereinto by reference.

BACKGROUND OF THE INVENTION

1. Field of the Invention

The present invention relates to a printing apparatus and a density variation correction method and more particularly to a printing apparatus and a density variation correction method which optically detect density variations and, based on the result of detection, perform a density variation correction.

2. Description of the Related Art

With the widespread use of information equipment in recent years, the use of printing apparatus, the peripheral devices of the information equipment, is also spreading quickly. Among the printing systems there are a wire-dot system, a thermosensitive system, a heat transfer system, and an ink jet system. Because of the advantages of low noise, low running cost, small size, and ease with which color inks can be introduced, the ink jet system in particular has found a wide range of applications including printer, facsimile and copying machine.

In a print head of a serial type ink jet system, for example, a plurality of nozzles are arranged in a direction perpendicular to a scan direction of the print head. Ink droplets are ejected from these nozzles to form an image.

However, the nozzles often have differing ejection characteristics, including the amount of ink ejected and the ink ejection speed, due to parts tolerances, variations in manufacturing processes, or changes with the passage of time. Increased ejection characteristic variations lead to density variations, resulting in banding and striped variations, significantly degrading the quality of a formed image.

The striped variations are density variations in the form of stripes extending in the main scan direction which in many cases appear periodically and therefore are very conspicuous, badly deteriorating the image quality. There are the following possible factors for such striped variations. In a so-called multinozzle type printing unit with a number of ink nozzles, in which a heater (electrothermal transducer) is installed in each ink passage communicating with the corresponding nozzle to produce heat energy for ejecting ink, the following factors may be listed as the possible causes for the striped variations.

(1) Variations in the amount of ejected ink and in the ejection direction caused by variations in the size of heaters and nozzles;

(2) Deviations between the feed of the print medium and the print width in the serial scan system;

(3) Differences in an ink density change between differing print times; and (4) Movement of ink on the print medium.

A variety of methods have been proposed to prevent the striped density variations to enhance image quality.

For example, Japanese Patent Application No. 59-31949 (1984) discloses a method which, when the print unit of a serial scan system repeats the scan operation in the main scan direction to print one line of an image at one time, prevents striped variations from being formed at a joint between adjacent lines of print areas. This method overlaps the lowermost end of the preceding line of print area and the uppermost end of the next line of print area, with the image at the joined portion between the two print areas completed by two scans.

Another method for enhancing the image quality by eliminating striped variations is a divided printing method (multipass printing method) which completes one print area on the print medium by scanning the print unit over the area a plurality of times. This divided printing method is effective in eliminating the striped variations. To produce a sufficient effect of this method, however, the number of scans of the print unit over one print area, i.e., the number of divisions, needs to be increased, which in turn leads to an increased throughput.

A method for suppressing the striped variations without using the divided printing method is, for example, a head shading method such as described in Japanese Patent Application Laid-Open No. 5-69545 (1993).

This method performs as follows. First, the print unit prints a predetermined test pattern for determining a correction value on the print medium. The density of the printed test pattern is read one line at a time by a scanner with solid-state image sensors such CCDs. Then, the read image is position-corrected properly, after which the densities of individual lines of the image are allocated to the rasters corresponding to the nozzles of the print unit. Changes in the density of the printed image are caused by errors in the ink ejection amount among the nozzles, the deviations of ink ejection direction, or the spreading of ink over the print medium.

Next, from the density data corresponding to the individual rasters, the correction value of print density is determined for each nozzle. Then, based on the correction values, a $\gamma$ table or a drive table for individual nozzles is modified to change the amount of ink to be ejected. These corrections include such a density correction as an output $\gamma$ correction which lowers the density of the rasters that print darker than desired when no correction is made. For the rasters that print lighter than desired when no correction is made, the density correction such as output $\gamma$ correction is performed to increase the density of these rasters, thereby reducing the density variations (striped variations).

An example method using an input device such as a scanner is disclosed in Japanese Patent Application Laid-Open No. 1-41375 (1989). This method involves printing a patch pattern for each of cyan (C), magenta (M), yellow (Y) and black (K) inks, reading these patch patterns with a scanner incorporating image sensors such as CCDs, detecting a deviation between the density value thus read and a density value expected of each patch pattern and, based on the detected deviation, correcting the density value of image data. The CCDs used in the scanner have almost the same resolution as the density of the dots forming the printed patch and thus can read the density in units of dot. It is therefore possible to make corrections in units of nozzle corresponding to each dot.

In the conventional technology described above that corrects the density based on the read data of the test pattern, however, the density of the test pattern is read one line or one dot at a time by an expensive scanner using CCDs. It is difficult to assume that all users of the printing apparatus have such an expensive scanner. Therefore, the printing method capable of the above-described density correction is considered inappropriate for personal users.

Because the test pattern is read one line or one dot at a time depending on the scanner used, the reading takes a large amount of time. Further, an additional function is required to calculate the correction value of the print density from the read data of the test pattern.

Further, when the printing apparatus is fitted integrally with a test pattern reading scanner, the overall size and cost of the apparatus will increase.

SUMMARY OF THE INVENTION

An object of the present invention is to solve these problems, i.e., to provide a test pattern printing method, an information processing apparatus, a printing apparatus and a density variation correction method, all capable of obtaining output characteristics of a print unit and determining a correction value for output density.

In a first aspect of the present invention, there is provided a printing apparatus for performing a printing operation with a print head having a plurality of print elements, comprising:

an optical sensor having a light emitting portion and a light receiving portion;

pattern forming means for printing on a print medium a plurality of predetermined patterns conforming to a light emitting wavelength range of the optical sensor, each of the plurality of patterns being formed by each corresponding print element or each corresponding block made up of a plurality of print elements;

measuring means for emitting light from the light emitting portion of the optical sensor against the patterns printed on the print medium by the pattern forming means and measuring optical characteristics of the plurality of patterns; and correction means for correcting image data to be used by the print head according to the optical characteristics measured by the measuring means.

In a second aspect of the present invention, there is provided a density variation correction method using a printing apparatus, the printing apparatus performing a printing operation by using a print head having a plurality of print elements, the correction method comprising:

a step of using an optical sensor having a light emitting portion and a light receiving portion; a pattern forming step for printing on a print medium a plurality of predetermined patterns conforming to a light emitting wavelength range of the optical sensor, each of the plurality of patterns being formed by each corresponding print element or each corresponding block made up of a plurality of print elements;

a measuring step for emitting light from the light emitting portion of the optical sensor against the patterns printed on the print medium by the pattern forming step and measuring optical characteristics of the plurality of patterns; and a correction step for correcting image data to be used by the print head according to the optical characteristics measured by the measuring step.

In a third aspect of the present invention, there is provided a test pattern printing method for printing on a predetermined print medium a test pattern whose density is optically detected by a density sensor to obtain output characteristic information on a plurality of nozzles provided in a print unit mounted on the printing apparatus, the test pattern printing method comprising the steps of:

dividing a nozzle array made up of a plurality of nozzles provided in the print unit into a plurality of nozzle blocks; and printing each of patches in a size and shape that enables the density of the patch to be optically detected by the density sensor by using only the nozzles of the same nozzle block allocated to the patch being printed;

wherein the test pattern comprises a plurality of patches.

In a fourth aspect of the present invention, there is provided an information processing apparatus for printing on a predetermined print medium a test pattern whose density is optically detected by a density sensor to obtain output characteristic information on a plurality of nozzles provided in a print unit mounted on a printing apparatus, the information processing apparatus comprising:

a means for dividing a nozzle array made up of a plurality of nozzles provided in the print unit into a plurality of nozzle blocks; and a means for printing each of patches in a size and shape that enables the density of the patch to be optically detected by the density sensor by using only the nozzles of the same nozzle block allocated to the patch being printed;

wherein the test pattern comprises a plurality of patches.

In a fifth aspect of the present invention, there is provided a printing apparatus for printing on a predetermined print medium a test pattern whose density is optically detected by a density sensor to obtain output characteristic information on a plurality of nozzles provided in a print unit mounted on the printing apparatus, the printing apparatus comprising:

a means for dividing a nozzle array made up of a plurality of nozzles provided in the print unit into a plurality of nozzle blocks; and a means for printing each of patches on the print medium by using only the nozzles of the same nozzle block allocated to the patch being printed;

wherein the test pattern comprises a plurality of patches.

The above and other objects, features and advantages of the present invention will become more apparent from the following description of embodiments thereof taken in conjunction with the accompanying drawings.

BRIEF DESCRIPTION OF THE DRAWINGS

FIG. 12 is a table showing example correction values for the corresponding nozzles that are set in the first embodiment of the invention;

FIG. 18 is a table showing one example of correction values for the corresponding nozzles set in the second embodiment of the invention;

FIGS. 33A to 33E are schematic diagrams showing density variation detection patterns;

FIG. 36 is a table showing correction values corresponding to output values of A, B, C and D;

DETAILED DESCRIPTION OF THE PREFERRED EMBODIMENTS

[First Embodiment]

(Outline)

In this embodiment a nozzle array in the printing unit is divided into a plurality of blocks of adjoining nozzles, with each block assigned to print a predetermined print pattern (patch).

These blocks of nozzles are called nozzle blocks. One patch is printed by using only the nozzles of the corresponding nozzle block. A density sensor installed in the printing apparatus measures an optical characteristic (density) of the patch to obtain print characteristic data of the nozzle block that printed the patch. Then, a relation among the data thus obtained is determined and, based on the relation, a density variation correction value is determined for each block. Then, the data and the nozzles used for printing are related with each other and, by referencing the correction value corresponding to each nozzle, a γ correction table used for the processing of print data is modified. According to the modified γ correction table, the print image data is processed.

(Mechanical Construction in Printing Apparatus)

Figure 1:
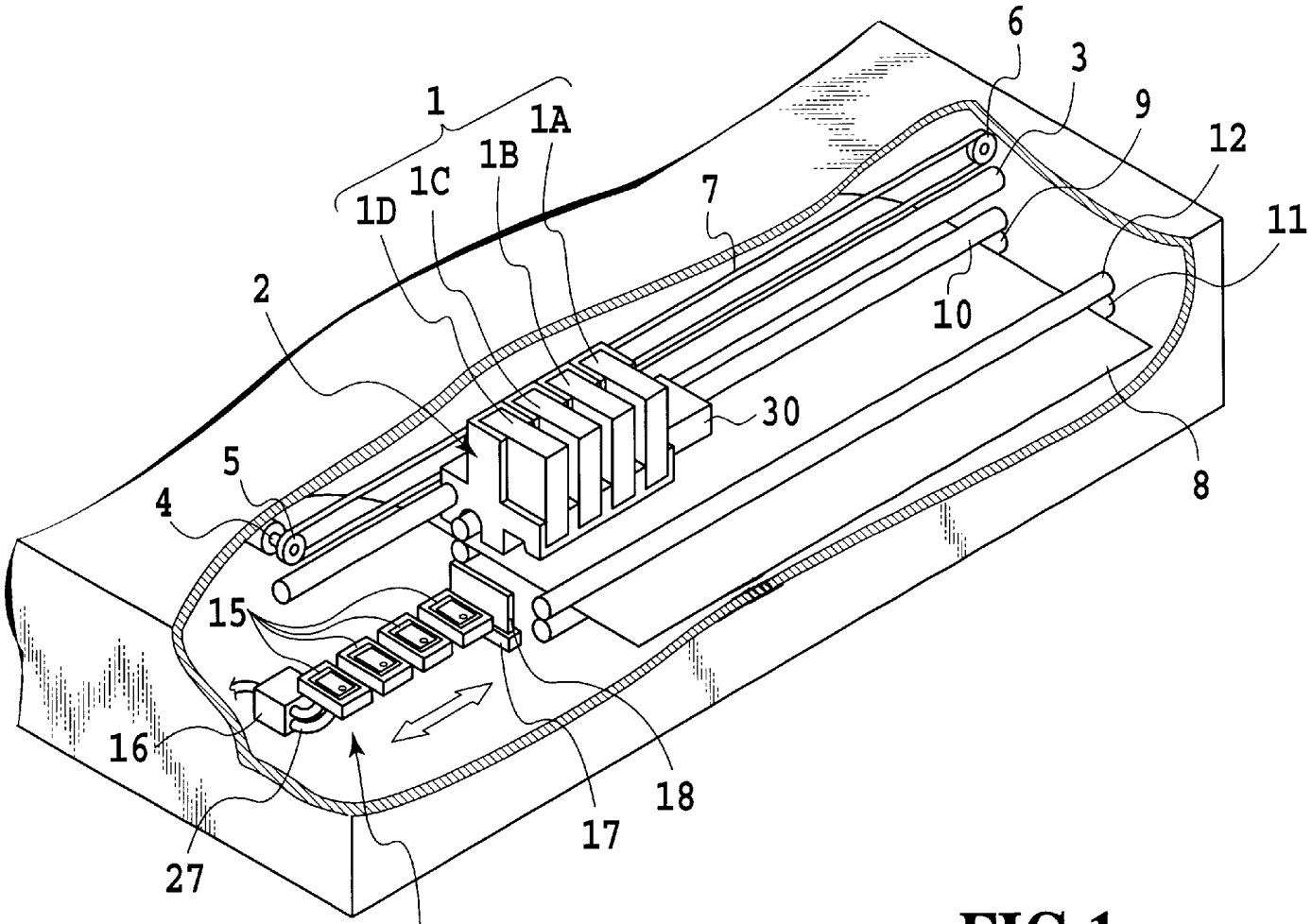
FIG. 1 is a perspective view showing a first example of mechanical construction of an ink jet printing apparatus applying the present invention.

FIG. 1 is a perspective view showing a first example of the mechanical construction of the ink jet printing apparatus applying the present invention.

In FIG. 1, the printing unit for printing on a print medium comprises a plurality of head cartridges 1A, 1B, 1C, 1D (four cartridges in this case) and a carriage 2 removably mounting these head cartridges. The head cartridges 1A to 1D each have a print head 13 (see FIG. 3) and an ink tank. Each print head 13 is provided with a connector for receiving a drive signal.

In the following description, when the entire head cartridges 1A to 1D or any one of the head cartridges are specified, they are represented as head cartridge(s) 1.

The head cartridges 1 perform printing using different inks and the ink tanks mounted on the head cartridges 1 contain, for example, black, cyan, magenta and yellow inks. The head cartridges 1 are replaceably situated at predetermined positions in the carriage 2. The carriage 2 is provided with a connector holder (electric connecting portion) for transferring the drive signal through the connector to each head cartridge 1.

The carriage 2 is movably supported on a guide shaft 3 that is installed in the printing apparatus body so as to extend in the main scan direction. The carriage 2 is therefore reciprocally movable in the main scan direction. The carriage 2 is reciprocated by a main scan motor 4 through a drive mechanism including a motor pulley 5, a follower pulley 6 and a timing belt 7. The position and movement of the carriage 2 are controlled by a control system described later.

The print medium 8 such as paper and thin plastic sheet is fed by two pairs of feed rollers 9, 10 and 11, 12 to pass through a position (print area) facing the ink ejection surface of the head cartridge 1. The print medium 8 is supported at its back on a platen (not shown) so that it forms a flat print surface in the print area. In this case, the head cartridges 1 mounted on the carriage 2 have their ink ejection surfaces projecting downwardly from the carriage 2 in such a way that the ink ejection surfaces are parallel to the print medium 8 held between two pairs of feed rollers. Further, the carriage 2 is provided with a reflection type optical sensor 30 as a density sensor described later.

The head cartridge 1 is an ink jet head cartridge that ejects ink by utilizing thermal energy and has an electrothermal transducer to generate thermal energy. The printing unit of the head cartridge 1 converts electric energy applied to the electrothermal transducer installed in each nozzle into thermal energy, which causes a film boiling to generate a bubble in ink, ejecting the ink from the nozzle by the pressure of the bubble.

Figure 2:
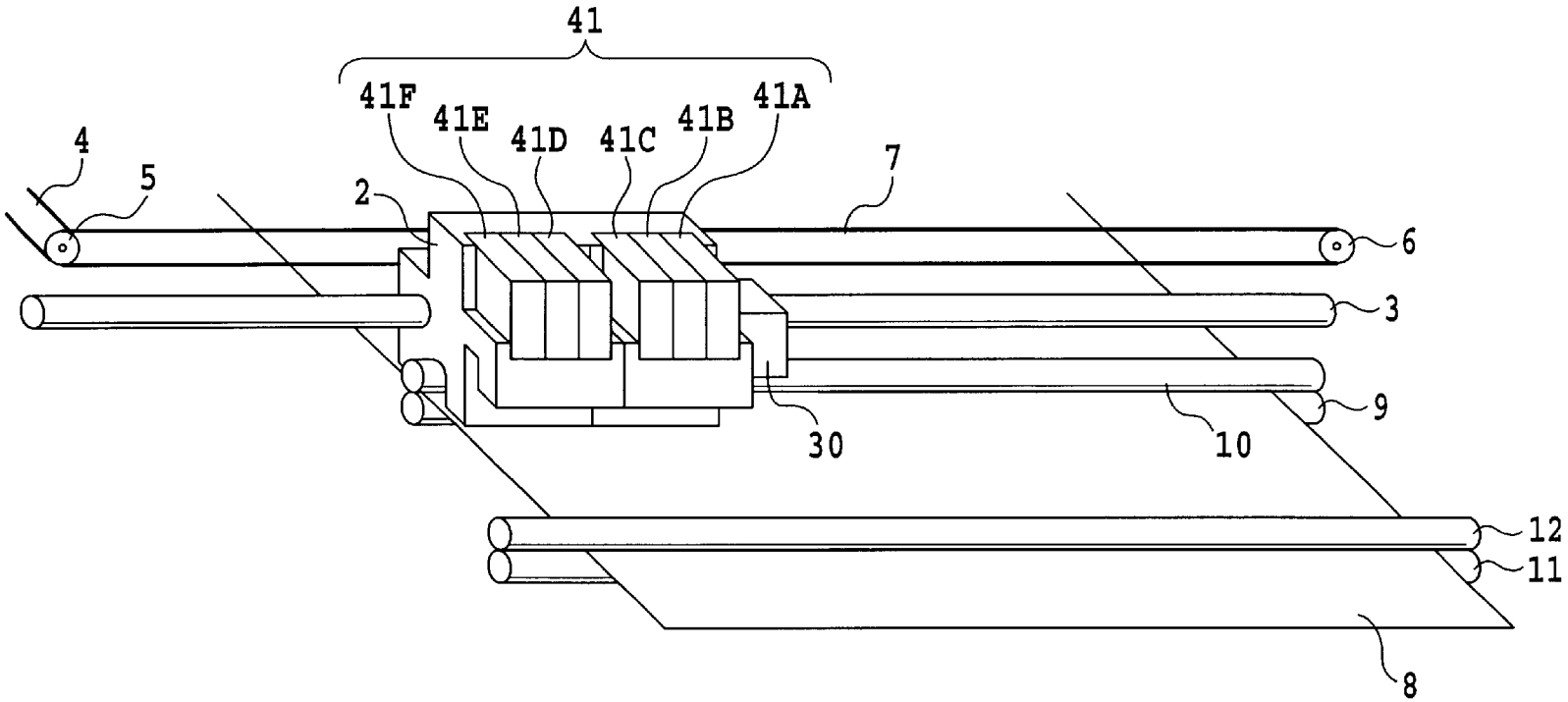
FIG. 2 is a perspective view showing a second example of mechanical construction of an ink jet printing apparatus applying the present invention.

FIG. 2 is a perspective view showing a second example of mechanical construction of an ink jet printing apparatus applying the invention. In FIG. 2, parts identical to those of FIG. 1 are assigned like reference numbers and their detailed explanations omitted.

In FIG. 2, the printing unit of the printing apparatus has a plurality (six) of head cartridges 41A, 41B, 41C, 41D, 41E, 41F and a carriage 2 on which these head cartridges are replaceably mounted. The cartridges 41A to 41F are each provided with a connector for receiving a drive signal for a print head 13 of each head cartridge 41. In the following description, the head cartridges 41A to 41F or any one of them are represented simply by a print head 41 or head cartridge 41.

The head cartridges 41 use different color inks for printing and their ink tanks accommodate different inks, for example, black, cyan, magenta, yellow, light cyan and light magenta inks. The head cartridges 41 are mounted replaceably at predetermined positions in the carriage 2. The carriage 2 is provided with a connector holder (electric connecting portion) for transmitting a drive signal to each head cartridge through the connector. Other constructions are similar to those of the first example and thus their explanations are omitted.

Figure 3:
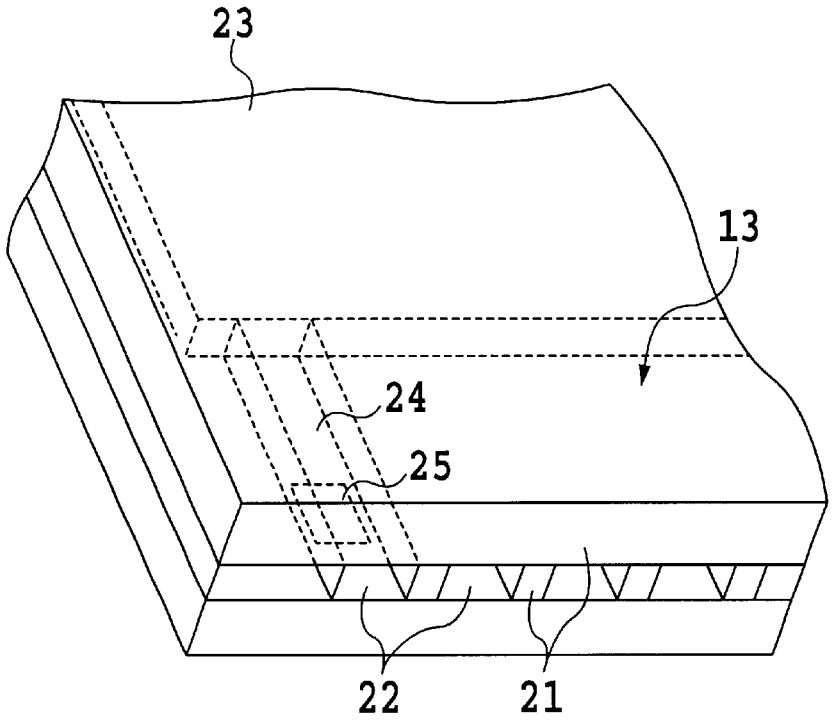
FIG. 3 is a perspective view schematically showing a part of a print head of a head cartridge.

FIG. 3 is a perspective view schematically showing a part of the print head 13 in the head cartridge 1 or 41.

An ink ejection surface 21 of the print head facing the print medium 8 supported in the print area as described above, with a predetermined gap (for example, 0.5 to 2 mm) between the ink ejection surface and the print medium, is formed with a plurality of nozzles 22 at predetermined pitches. An electrothermal transducer (heating resistor or the like) 25 to generate thermal energy for ejecting ink is arranged along the wall surface of each liquid passage 24 communicating the corresponding nozzle 22 to a common liquid chamber 23.

The head cartridge 1 or 41 is mounted on the carriage 2 so that its nozzles 22 are arranged in a direction perpendicular to the scan direction of the carriage 2. According to an image signal or ejection signal, the corresponding electrothermal transducer (hereinafter referred to also as an "ejection heater") is driven (energized) to film-boil the ink inside the liquid passage 24 to eject the ink from the nozzle 22 by the pressure generated by the boiling. The print head 13 has the above construction.

Figure 4:
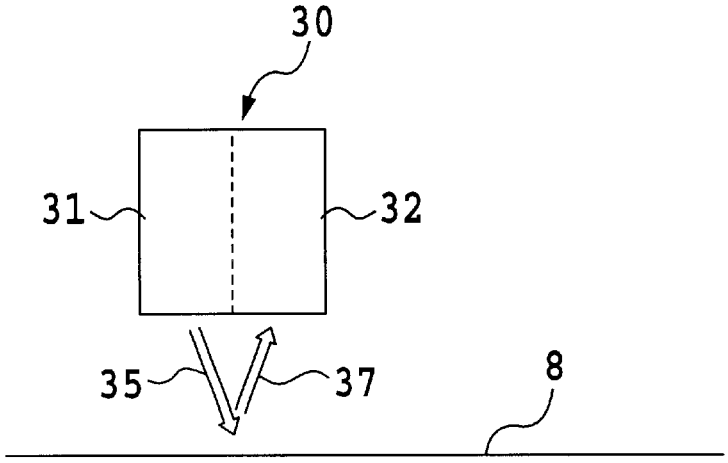
FIG. 4 is a side view schematically showing the construction of a reflection type optical sensor 30 shown in FIG. 1 or 2.

FIG. 4 is an explanatory side view schematically showing the construction of a reflection type optical sensor 30 of FIG. 1 or 2. As shown in FIG. 4, the reflection type optical sensor 30 attached to the carriage 2 has a light emitting portion 31 and a light receiving portion 32. The light emitting portion 31 emits light (incident light) 35 onto the print medium 8, while the light receiving portion 32 receives light (reflected light) 37 from the light emitting portion 31 reflected by the print medium 8 and outputs a detection signal according to the power of the received light.

The detection signal output from the light receiving portion 32 is sent through a flexible cable (not shown) to a control circuit formed on a printed circuit board in the printing apparatus. The detection signal is then converted into a digital signal by an A/D converter in the control circuit. The position on the carriage 2 where the reflection type optical sensor 30 is mounted is set where the nozzles of the print head 13 do not pass during the scan for printing in order to prevent adhesion of splashed ink to the sensor. Because the apparatus can use an optical sensor 30 with a relatively low resolution, the sensor cost is significantly lower than an image sensor with a high resolution CCDs. By changing the pulse width of the drive signal for the light emitting portion 31 by an MPU in the printer, the amount of light emitted can be changed. The pulse width of the drive signal can be modulated in a minimum unit that produces a change in the amount of light.

Figure 5:
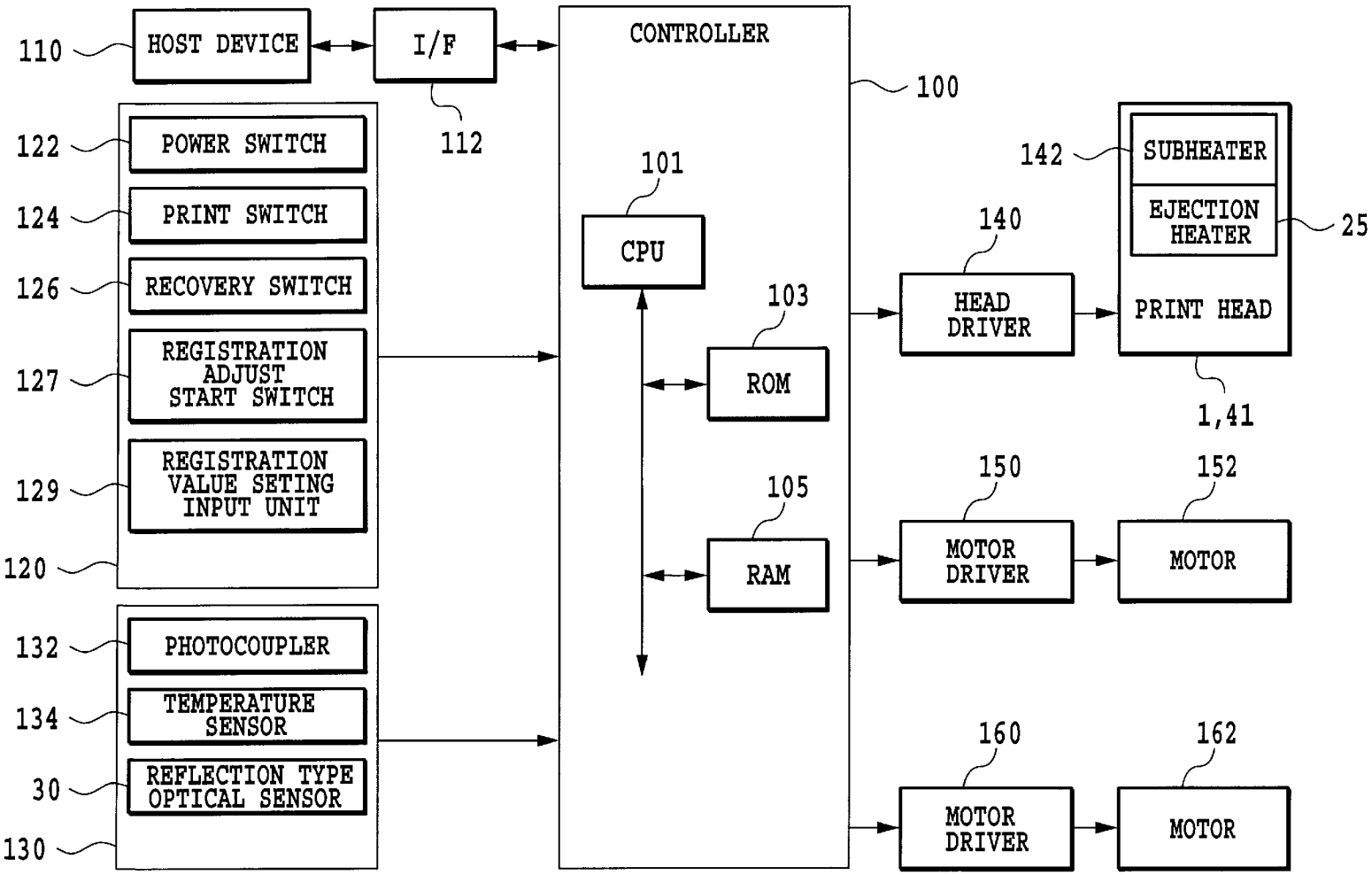
FIG. 5 is a block diagram showing the configuration of a control system circuit in each embodiment of the invention.

FIG. 5 is a block diagram showing a configuration of the control system circuit of an embodiment of the invention.

In FIG. 5, a controller 100 is a main control unit that controls the entire printing apparatus. This controller has a CPU 101 in the form of a microcomputer, a ROM 103 storing programs, tables and other fixed data, and a RAM 105 used as an area in which to map print data and as a work area. A host device 110 has a function of supplying print data and thus can be applied in the form of a computer or the like that generates and processes image data and also in the form of a reader unit or the like for reading images. The print data and other command and status signals output from the host device 110 are transferred to the controller 100 through an interface (I/F) 112.

The input side of the controller 100 is connected with an operation unit 120 and a sensor group 130. The operation unit 120 has switches and an input setting unit for an operator to enter commands and settings. The switches include a power switch 122, a print start switch 124, a recovery switch 126 for starting the suction-powered ejection performance recovery operation, and a registration start switch 127 for manually performing registration adjustment. The input setting unit includes a registration value setting input unit 129 for manually entering the adjust value.

The sensor group 130 is for detecting the state of the printing apparatus and includes the above-mentioned reflection type optical sensor 30, a photocoupler 132 for detecting the home position of the carriage 2, and a temperature sensor 134 installed at an appropriate location to detect an ambient temperature of the head cartridge 1 or 41.

The output side of the controller 100 is connected with a head driver 140 and motor drivers 150, 160. The head driver 140 drives the ejection heater 25 of the print head 13 according to the print data. The head driver 140 has a shift register for arranging the print data according to the position of the ejection heater 25, a latch circuit for latching the print data at an appropriate timing, a logic circuit element for activating the ejection heater in synchronism with the drive timing signal, and a timing setting unit that properly sets the drive timing (ejection timing) for alignment of dot forming positions.

The print head 13 is further provided with a sub-heater 142 which adjusts the temperature of ink to stabilize the ink ejection characteristic. The sub-heater 142 may be formed on the print head substrate simultaneously with the ejection heater 25, or attached to the print head body or head cartridge. The motor driver 150 drives a main scan motor 152 and a sub-scan motor 162 is used to feed (sub-scan) the print medium 8. The motor driver 160 drives this motor 162.

Figure 20:
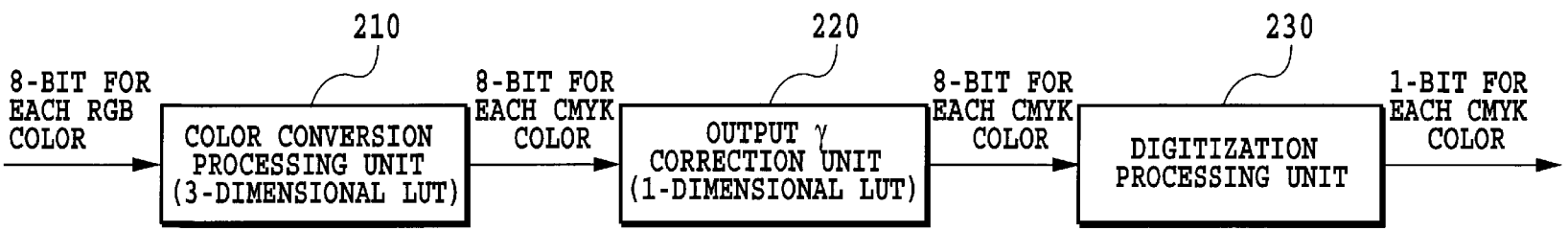
FIG. 20 is a block diagram showing a configuration of a processing unit that processes input image data to generate print data.

Next, the image processing in the printing apparatus used in this embodiment will be explained. FIG. 20 is a block diagram showing a configuration of a processing unit that processes input image data to generate print data.

The image processing unit in this embodiment inputs 8-bit image data of R (red), G (green) and B (blue) for each pixel, i.e., 256-gray-scale image data for each color. The image data is output as 1-bit image data for each pixel for each ink color, C (cyan), M (magenta), Y (yellow) and K (black).

That is, the 8-bit image data for each color of R, G and B is converted into 8-bit data for each ink color of C, M, Y and K by a 3-dimensional lookup table (LUT) that functions as a color conversion unit 210. This processing is color conversion processing that converts an input RGB system color signal to an output CMYK color signal.

The input data from an input system is often 3-primary color (RGB) data of additive color mixing used in a light emitting device such as display. When a color is represented by the reflection of light in an output system such as printer, colorants of three primary colors (CMY) of subtractive color mixing are used. Hence, the above-described color conversion processing is required. The 3-dimensional LUT used in this color conversion processing holds discrete data and determines values between the existing data by interpolation. The interpolation is a known technique and its explanation is omitted here.

The 8-bit data for each of CMYK ink colors that have undergone the color conversion processing is subjected to an output γ correction by a 1-dimensional lookup table (LUT) that is used as an output γ correction unit (output density correction unit) 220. The relationship between the number of dots in a unit area on the print medium and the output characteristic such as reflection density is, in many cases, not linear. Thus, by performing the output γ correction, the relation between the 8-bit input level of each ink color of C, M, Y and K and the output characteristic of each C, M, Y, K ink is corrected to become linear. The 1-dimensional LUT used as the output γ correction table is prepared for all nozzles of each print head and is changed by a density variation correction value described later.

In this manner, the 8-bit input data for each R, G, B color is converted into 8-bit data of each C, M, Y, K ink color in the printing apparatus. Then, the 8-bit data of each ink color is converted into 1-bit binary data by a digitization processing unit before being supplied to the head driver 140.

(Flow of Processing)

Figure 6:
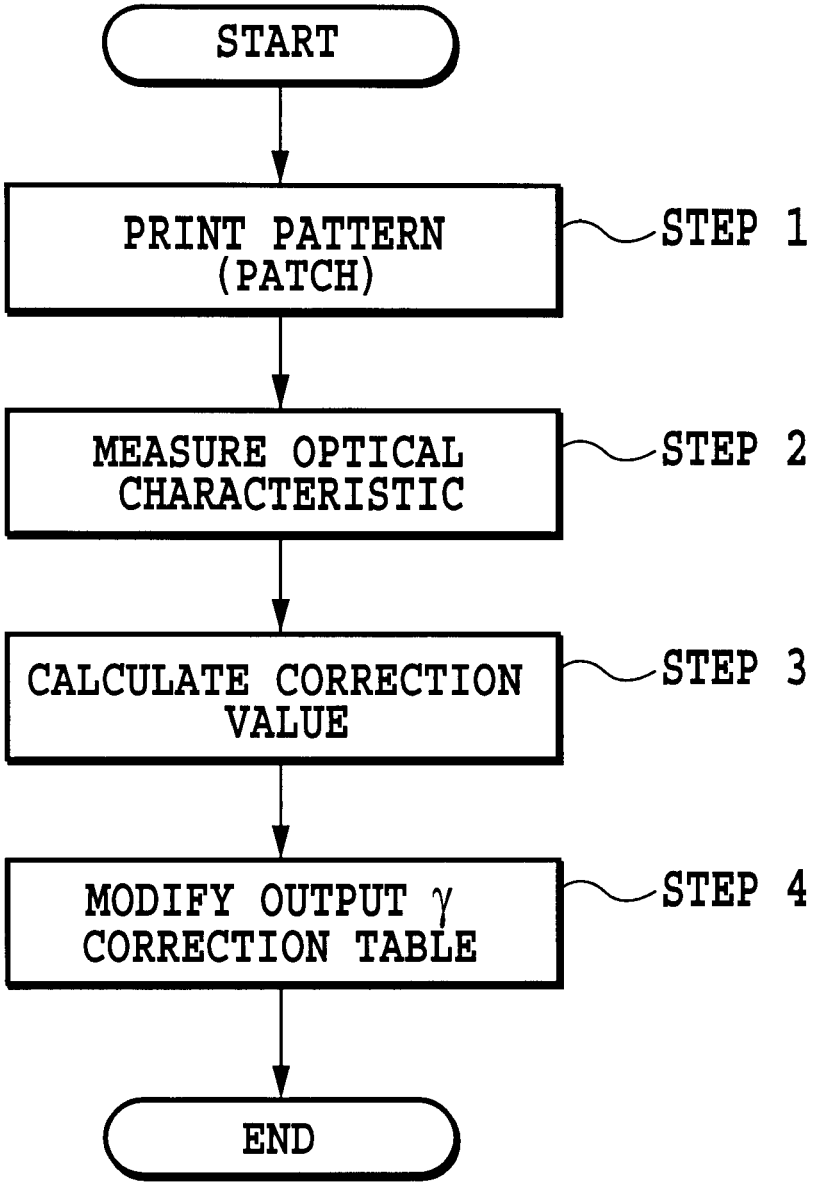
FIG. 6 is a flow chart showing an outline of processing for obtaining a density variation correction value used in each embodiment of the invention.

FIG. 6 is a flow chart showing an outline of processing executed in this embodiment of the invention to obtain a density variation correction value.

First, a predetermined pattern is printed (step 1). This pattern consists of a plurality of patches described later which correspond to at least each of the associated nozzle blocks, respectively. Next, the optical characteristics of these patches are measured by the density sensor 30 mounted on the carriage 2 (step 2). Then, a correlation among these values is determined and, based on this correlation, the density variation correction value is calculated (step 3). Then, based on the calculated correction value, the output γ table is changed by the output γ correction unit 220 (step 4).

(Printing of Pattern)

Figure 7:
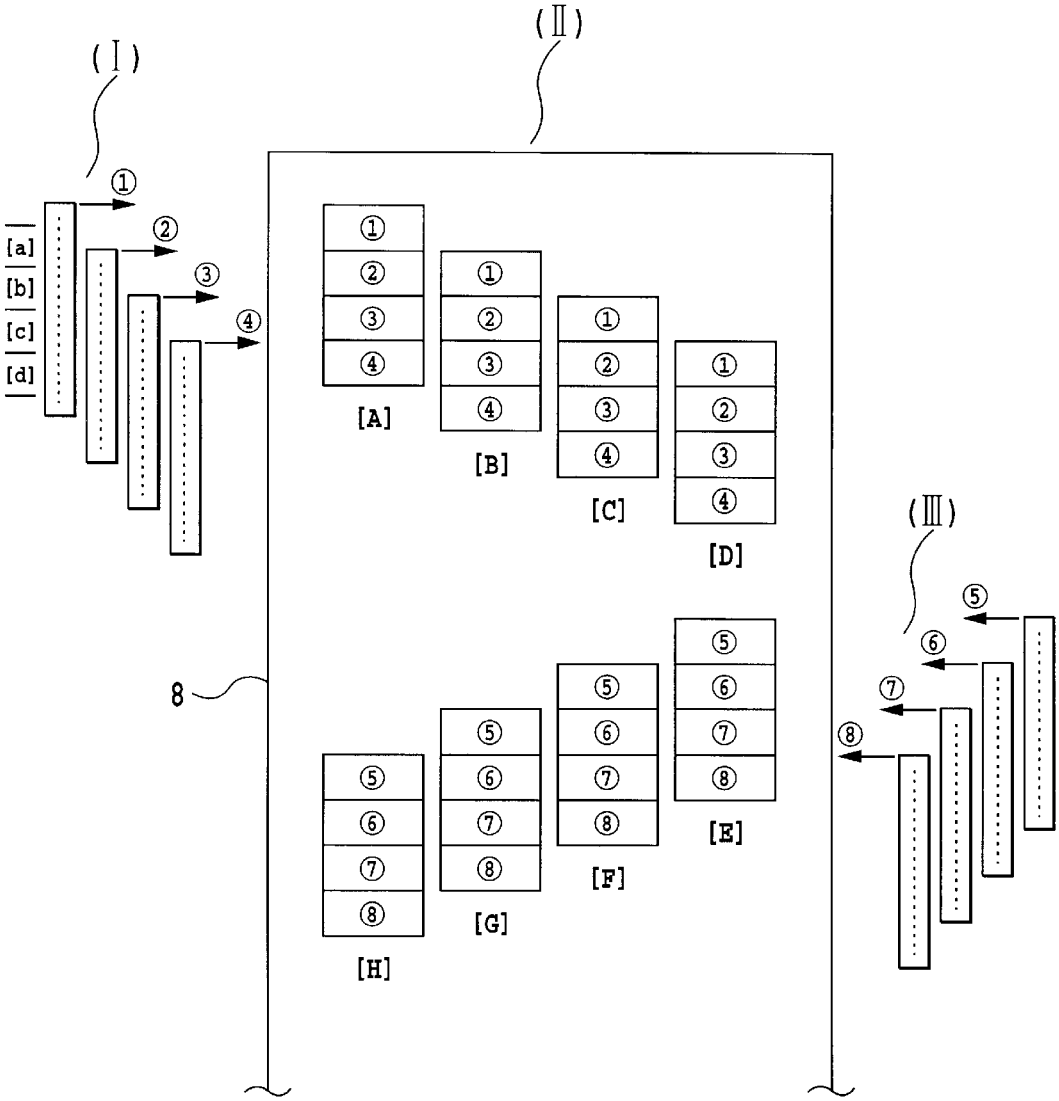
FIG. 7 is a schematic diagram showing a print pattern in the first embodiment of the invention and a procedure for generating the print pattern.

FIG. 7 is a schematic diagram showing a print pattern in the first embodiment of the invention used in the density variation correction processing and a procedure for generating the print pattern. To simplify the explanation, we take up an example case where single-color nozzles are used. In this embodiment a column of nozzles in the print head 13 is divided into four nozzle blocks for printing a test pattern. In the figure, patches [A] to [D] in the pattern printed on the print medium are those printed during the forward scan operation, while patches [E] to [H] are those formed by the backward scan operation.

In FIG. 7, (I) represents the positions of the print head 13 with respect to the print medium during first to fourth scan operations, with (1) indicating the position of the print head 13 during the first scan. In the figure, a dotted line shown in the print head 13 denotes a nozzle column. [a] to [d] represent nozzle blocks in this embodiment. The nozzle blocks [a] to [d] are set to have the same number of nozzles and the same length.

The first scan prints a part of each of the patches [A] to [D] on the print medium marked with (1). At this time, a nozzle block [a] of the nozzle column prints a part of the patch [A], a nozzle block [b] prints a part of the patch [B], a nozzle block [c] prints a part of the patch [C], and a nozzle block [d] prints a part of the patch [D].

Then, the print medium is moved a distance equal to the length of one nozzle block. The position of the moved print head with respect to the print medium is indicated by (2) of (I) in FIG. 7. Then, another part of each of the patches [A] to [D] is printed, as in the first scan. After this, the print medium is again moved a distance corresponding to the length of one nozzle block and the third printing scan is performed. This is followed by the feeding of the print medium and then the fourth printing scan. Now, the patches [A] to [D] shown in the figure are completely printed. In the above-described printing scan, the patch [A] is formed by using only the nozzles of the nozzle block [a], the patch [B] by only the nozzles of the nozzle block [b], the patch [C] by only the nozzles of the nozzle block [c], and the patch [D] by only the nozzles of the nozzle block [d].

Next, the similar printing scan is performed by alternating the movement of the print head in the backward direction along the main scan direction and the feeding of the print medium in the sub-scan direction, as indicated by (5) to (8) at (III) in FIG. 7. This operation forms the patches [E] to [H].

Here, the patch [E] is formed by using only the nozzles of the nozzle block [a]. Similarly, the patch [F] is formed by using only the nozzles of the nozzle block [b], the patch [G] by only the nozzles of the nozzle block [c], and the patch [H] by only the nozzles of the nozzle block [d]. These patches each have a vertical width of 4 lines.

(Measurement of Optical Characteristic)

Figure 8:
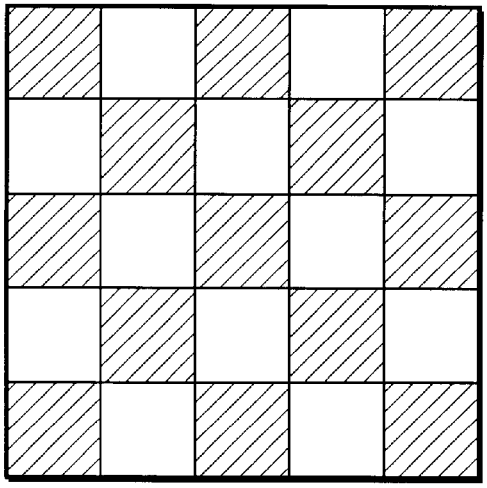
FIG. 8 is a plan view of a pattern suited for forming a half-tone image.

To reflect the characteristics of the nozzle blocks sensitively on the optical characteristic of the patches, the patch pattern should preferably be a half-duty pattern. A preferred half-duty pattern may, for example, be a check pattern as shown in FIG. 8. This is because the size and shape of dots are considered to greatly affect an area coverage of the patch (a percentage indicating how much of the area of the print medium that needs to be printed is covered with the printed dots; also called an area factor). Further, in this embodiment, all the patches have a vertical width of four rasters, so their densities can be measured with sufficient precision by an inexpensive density sensor without using a high resolution CCD sensor.

Figure 9:
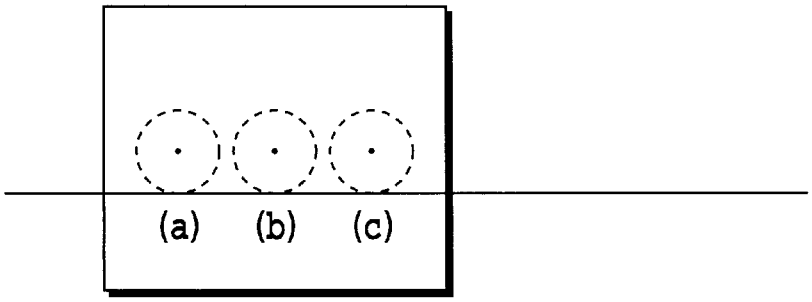
FIG. 9 is a plan view schematically showing how an optical characteristic of a patch is measured.

FIG. 9 is a plan view schematically showing how the optical characteristics of the patches printed as described above are measured. As shown in the figure, the density sensor on the carriage is moved over the print medium to come to positions corresponding to the patches and measures the optical characteristic at positions shown in FIGS. 9(*a*) to 9(*c*). In the figure, the dotted lines indicate ranges in which the density sensor measures the patch density. The possible optical characteristics to be measured include a reflective light intensity, a reflectance, and a reflective optical density. In this embodiment, a reflective optical density (or abbreviated OD) is measured. Other optical characteristics can also be used as long as they can measure how much of the incident light the printed patches reflect.

(Calculation of Correction Value)

By comparing the optical characteristic values among the patches, it is possible to calculate a relation among the nozzle blocks that indicates what level of density the array of nozzles in each nozzle block [a]–[d] can produce in the corresponding patch.

Figure 10:
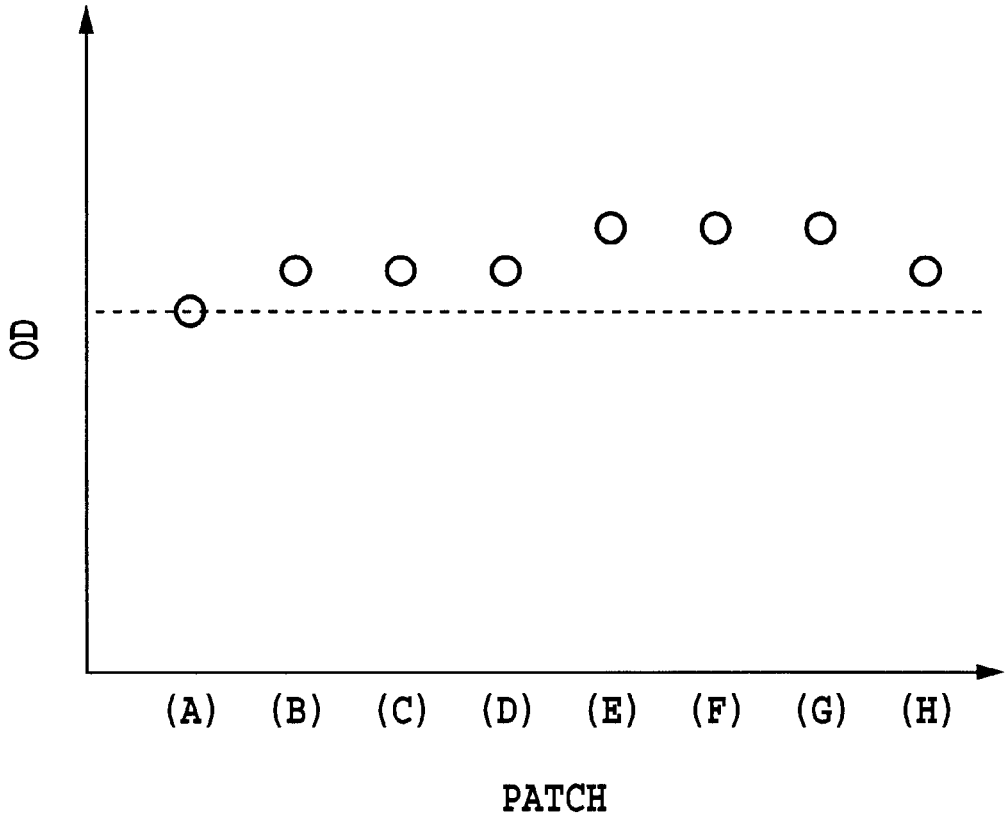
FIG. 10 is a diagram showing an example of OD obtained as a result of optical measurement in the first embodiment of the invention.

FIG. 10 is a graph showing an example result of optical measurements, i.e., the measured OD values corresponding to the patches [A] to [H] (shown in FIG. 7). Of these patches, [A] to [D] represent patches printed during the forward scan by the nozzle blocks [a] to [d], respectively, and [E] to [H] represent patches printed during the backward scan by the nozzle blocks [a] to [d].

In this embodiment, the OD value of each patch is divided by the smallest OD value detected to calculate an ROD value. Based on the ROD value, a correction value is calculated. In FIG. 10, the lowest OD level is shown with a dotted line.

Figure 11:
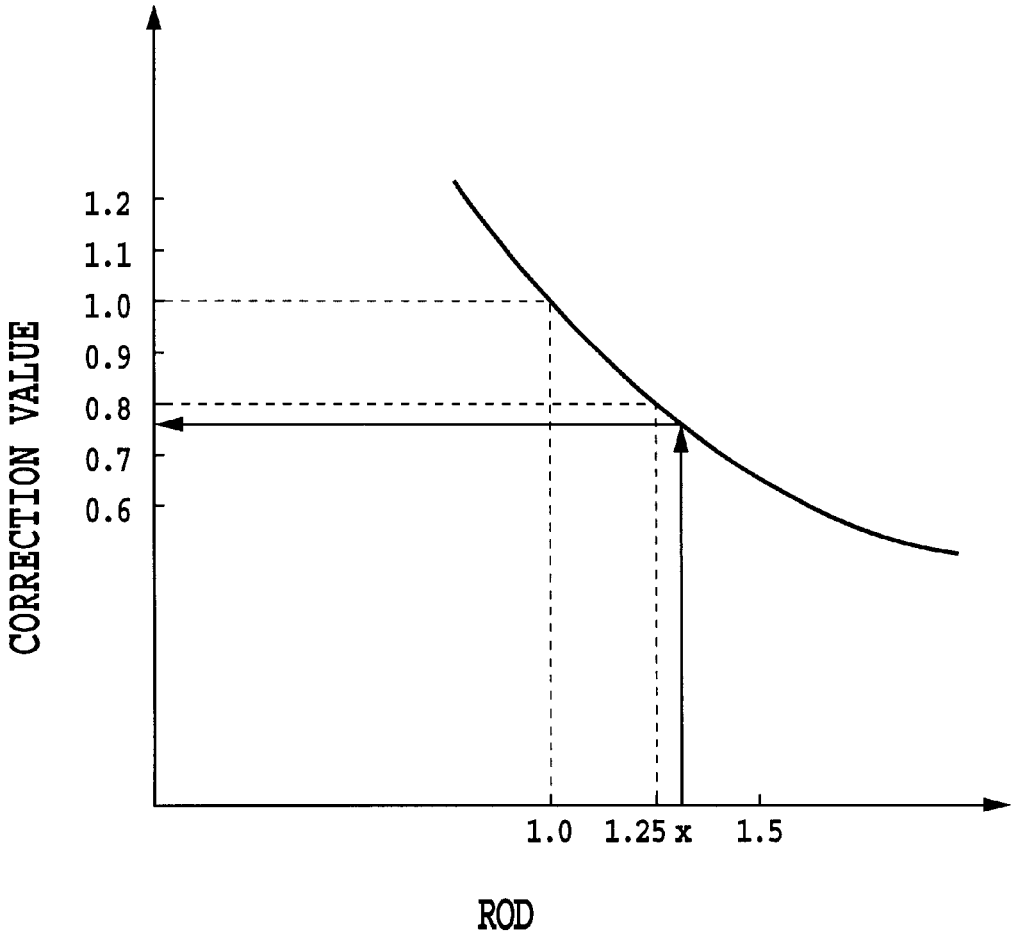
FIG. 11 is a diagram showing a curve representing the relation between an ROD value in the first embodiment of the invention and the corresponding correction value.

FIG. 11 shows a curve representing the relation between the ROD value and the corresponding correction value in this embodiment. With this curve it is possible to obtain a correction value suited for the ROD. That is, if the ROD has a value indicated by x in the figure, the curve shows that the corresponding correction value $\alpha$ is between 0.8 and 0.7. The correction value thus obtained is rounded off to one decimal place. In this way the correction values a determined for the corresponding ROD values range between 1.0 and 0.6. FIG. 12 shows example correction values for the corresponding nozzle blocks of one print head. The curve (conversion curve) of FIG. 11 that determines the relation between the ROD value and the correction value is an inversely proportional curve that passes through a point where the correction value is 1.0 when ROD=1.0.

(Modifying Output $\gamma$ Correction Table)

Based on the correction value $\alpha$ set as described above, this embodiment selects for each nozzle appropriate one of output $\gamma$ correction tables stored in advance in RAM and reads a density value from the output $\gamma$ correction table according to the print density value.

Figure 13:
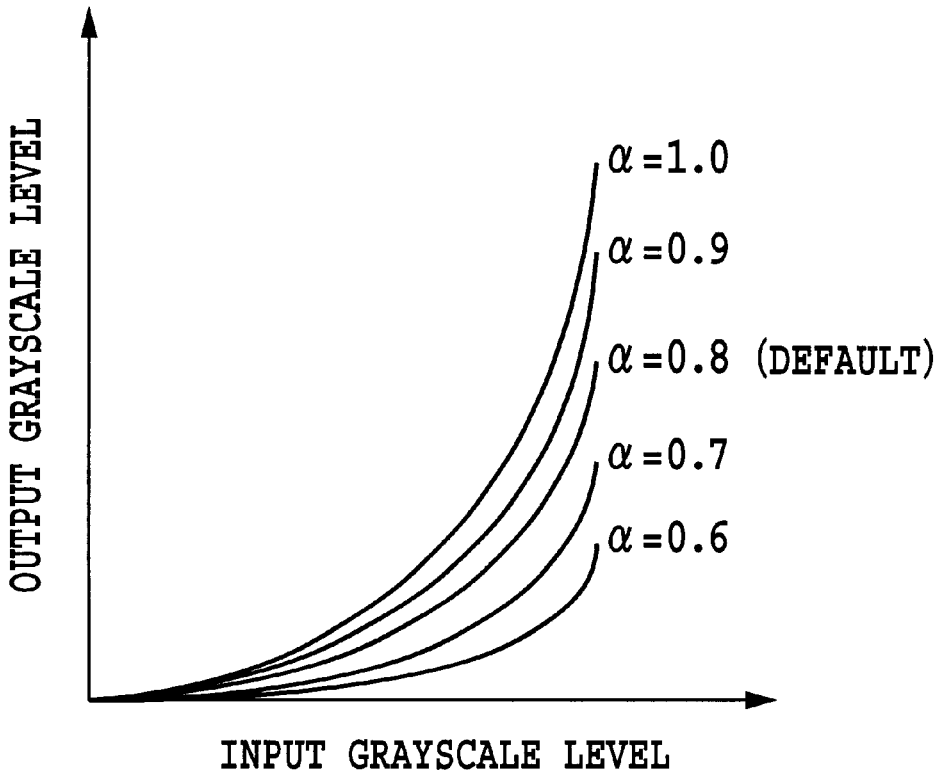
FIG. 13 is a diagram showing the content of an output γ correction table used in the first embodiment of the invention.

The output $\gamma$ correction tables used in this embodiment are as shown in FIG. 13. In this embodiment, an output $\gamma$ curve is set for each of the correction values 0.6, 0.7, 0.8, 0.9 and 1.0 determined for the corresponding ROD values as described above and these output $\gamma$ curves are stored in the RAM 105. When the correction value is 0.8, the print density obtained from the selected output $\gamma$ correction table is 20% lighter than the print density produced when the density is not corrected by the correction value.

(Printing Operation)

As described above, this embodiment uses the output $\gamma$ correction table selected according to the nozzle characteristic, corrects the input print data to generate corrected print data and, based on the corrected print data, performs printing in the print area.

In this first embodiment, a plurality of nozzles in the print head 13 are divided into nozzle blocks [a] to [d], and each of the patches is printed with only the nozzles of the same nozzle block allocated to the patch in such a dimension and shape that the patch density can be optically detected by the density sensor. In the first embodiment, therefore, it is possible to obtain the output characteristic of the print head by using an inexpensive, small density sensor, rather than an expensive CCD scanner, and to correct the output density according to the output characteristic with low cost and ease. Thus, by applying the first embodiment a printing apparatus with an output characteristic setting function can be realized with low cost.

While, in the first embodiment, a single patch has been described to be printed with four printing scans, it can be printed with fewer or more scans. In this case, too, each patch can be formed by the same nozzle block. The patches may be printed in any desired size and shape as long as they can be read by the density sensor. The number of nozzles making up a nozzle block may be set appropriately according to the size and shape of the patches to be formed and to the number of scans required for the patch printing.

[Second Embodiment]

(Outline)

In the first embodiment, all the nozzle blocks have the same width (the number of nozzles). In the second embodiment, the nozzle block widths (the number of nozzles) are not necessarily equal and vary depending on the characteristics of the print head and printing apparatus. That is, in this second embodiment, the widths of the nozzle blocks on both sides of the nozzle array are set short and those of the central nozzle blocks are set relatively long. With this arrangement, when the densities at the ends of the printing scan vary, the characteristics of the print head and printing apparatus can be adjusted. That is, by changing the length of the nozzle block according to the characteristics of the print head and the printing apparatus, the precision of the density variation correction can be enhanced while at the same time minimizing the number of nozzle blocks and the time for measurement.

One example of density variation that is intended to be eliminated by the second embodiment is described by referring to FIGS. 14 and 15.

The density variation is produced depending on the relation between the distance that the print medium is fed in the sub-scan direction between the two successive printing scans and the length of the nozzle array in the print head that is activated in one printing scan.

Figure 14A:
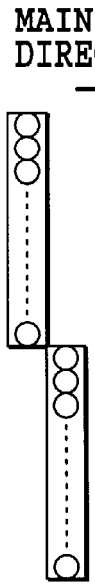
FIG. 14A is a schematic diagram showing a relative position of the print head with respect to the print medium when there is no feed error of the print medium.
Figure 14B:
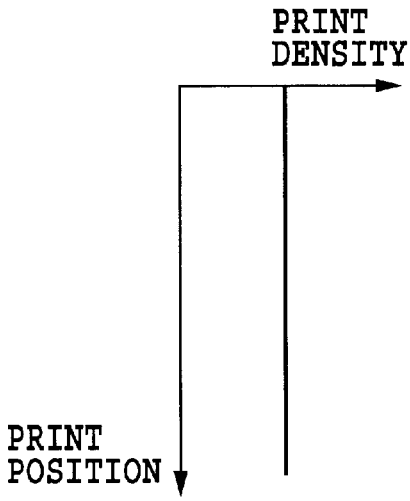
FIG. 14B is a diagram showing a relation between the print position and the print density for the case of FIG. 14A.

That is, when no density variation occurs, the length of each nozzle array and the distance that the print medium is fed between one printing scan and the next printing scan (paper feed distance) are equal, as shown in FIG. 14A. In this case, when the positions of the print head relative to the print medium during the two successive printing scans are considered, the rear end position of the nozzle array during the preceding printing scan and the front end position of the nozzle array during the next printing scan completely match, as shown in FIG. 14A. As a result, the densities on the print medium produced by the two printing scans are uniform as shown in FIG. 14B.

Figure 15A:
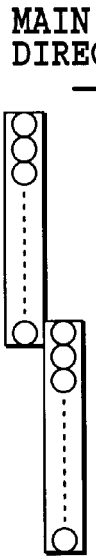
FIG. 15A is a schematic diagram showing a relative position of the print head with respect to the print medium when there is a feed error of the print medium.
Figure 15B:
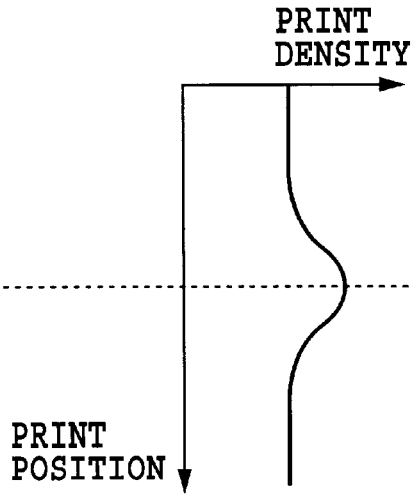
FIG. 15B is a diagram showing a relation between the print position and the print density for the case of FIG. 15A.

When the paper feed distance is shorter than the length of the nozzle array, however, the rear end position of the nozzle array during the preceding printing scan and the front end position of the nozzle array during the next printing scan overlap each other, as shown in FIG. 15A. Hence, more ink is delivered onto the print medium at the overlapping position than at other positions, making the density at that portion higher. When the amount of ink applied exceeds a predetermined amount, the ink immediately after having landed on the print medium flows out of an intended point, also increasing the density in other areas surrounding the overlapped portion. This is shown in FIG. 15B.

The second embodiment can also deal with a density variation resulting from the above-mentioned paper feeding, and how the density variation is corrected will be described below. The construction of the printing apparatus of this embodiment and the density variation correction procedure are similar to those of the first embodiment. In this embodiment, the density variation correction processing described here concerns a case where an image is formed by one-way printing.

(Printing of Pattern)

Figure 16:
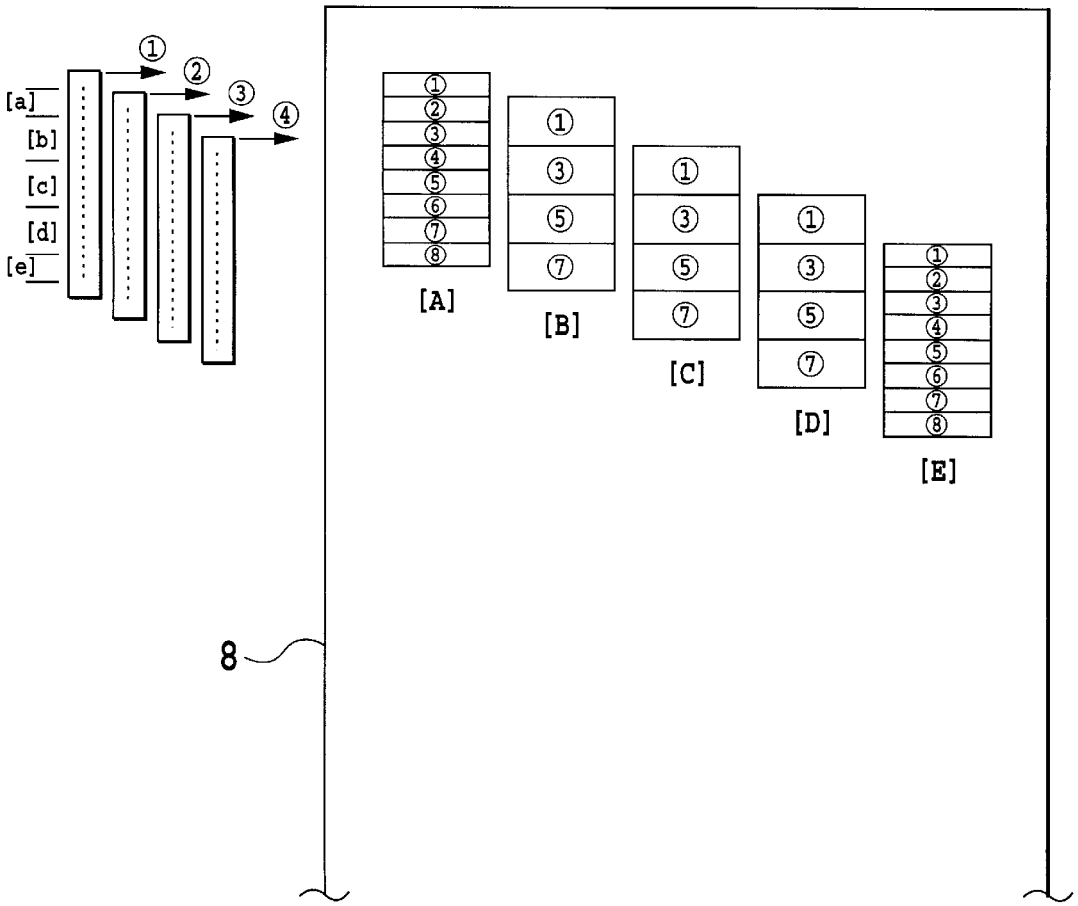
FIG. 16 is a schematic diagram showing a test pattern in the second embodiment of the invention and a process of forming the test pattern.

FIG. 16 is a schematic diagram showing a test pattern of the second embodiment and a procedure for generating the test pattern. What is shown in FIG. 16 is vertically longer than the actual size for the sake of explanation.

In the second embodiment, we described an example case where the nozzle array of the print head is divided into five nozzle blocks in printing a test pattern.

In FIG. 16, (I) represents the positions of the print head 13 with respect to the print medium for the first to fourth printing scans, respectively. The print patterns [A] to [E] shown here are completed by eight printing scans, but because of the lack of space the positions of the print head 13 for the fifth and subsequent printing scans are not shown at (I) of FIG. 16.

Here, reference symbol (1) represents the position of the print head for the first scan and the dotted line in the print head 13 indicates the nozzle array. [a] to [e] shown at (I) of FIG. 16 represent the nozzle blocks of this embodiment. In this embodiment, the blocks at the ends of the print head (the uppermost nozzle block [a] and the lowermost nozzle block [e] in the figure) are set to have half the width of other nozzle blocks.

In the second embodiment, too, only the nozzles of the assigned nozzle block are used to print the corresponding patch, as in the first embodiment. That is, the patch [A] is printed by using only the nozzle block [a], the patch [B] by only the nozzle block [b], the patch [C] by only the nozzle block [c], the patch [D] by only the nozzle block [d], and the patch [E] by only the nozzle block [e]. Because the nozzle block [a] and the nozzle block [e] have half the nozzle array width or half the number of nozzles in other nozzle blocks, the nozzle blocks [a] and [e] perform the printing operation in all the eight scans to print the patch [A] and the patch [E]. The nozzle blocks [b] to [d] perform the printing operation in only the odd-numbered scans of the total of eight scans to form the patches [B] to [D]. In this case, the distance that the print medium is fed between the succeeding printing scans is set equal to the width of the nozzle blocks [a] and [e], i.e., half the width of the nozzle blocks [b] to [d].

(Measurement of Optical Characteristic)

Figure 17:
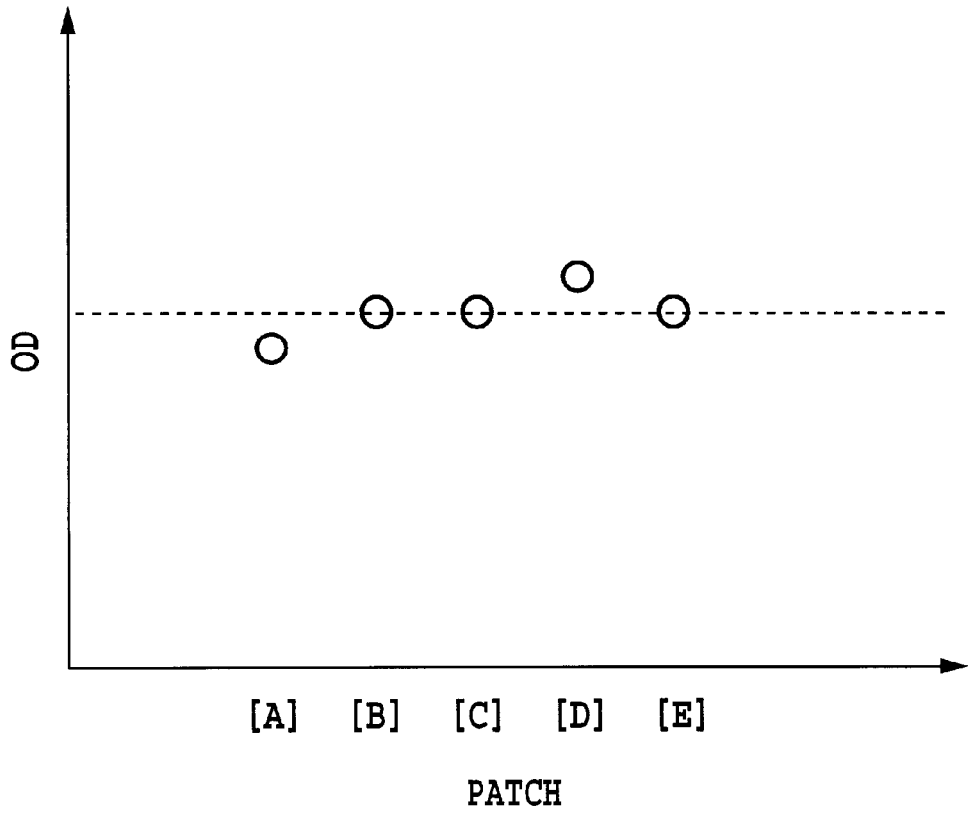
FIG. 17 is a diagram showing patch ODs detected by a density sensor mounted on the carriage in the second embodiment of the invention.

As in the first embodiment, the density sensor mounted on the carriage is moved to the positions of the patches to measure the optical characteristic. The optical characteristic measured is a reflective optical density (OD) as in the first embodiment. FIG. 17 shows an example of measured values. FIG. 17 shows measured reflective optical density (OD) levels of the patches [A] to [E].

(Calculation of Correction Value)

In the second embodiment, the smallest of the measured values for the nozzle blocks excluding the end nozzle blocks of the print head 13 is used as a reference value and the ratio of each reflective optical density to the reference value is calculated. In more concrete terms, excluding the patch [A] and patch [E] in FIG. 17, the patches with the smallest reflective optical density are the patch [B] and patch [C]. Hence, the measured reflective optical density of each patch [A] to [E] is divided by the reflective optical density of the patch [B] to determine an ROD for each patch. In FIG. 17, the reference levels of the patch [B] and patch [C] are indicated by a dotted line.

For the RODs thus obtained, correction values are calculated as in the first embodiment. That is, in the second embodiment, too, the correction value $\alpha$ is calculated by using a conversion curve shown in FIG. 11. In this embodiment, the calculated ROD may or may not be larger than 1.0, and the values obtained through the conversion curve are rounded off and assigned one of the correction values of 0.8, 0.9, 1.0, 1.1 and 1.2. If the ROD is larger than the level corresponding to the correction value of 0.8, it is allocated to the correction value of 0.8. If the ROD is smaller than the level corresponding to the correction value of 1.2, it is allocated to the correction value of 1.2. An example of correction values determined in this manner is shown in FIG. 18.

(Modification of Output $\gamma$ Correction Table)

Figure 19:
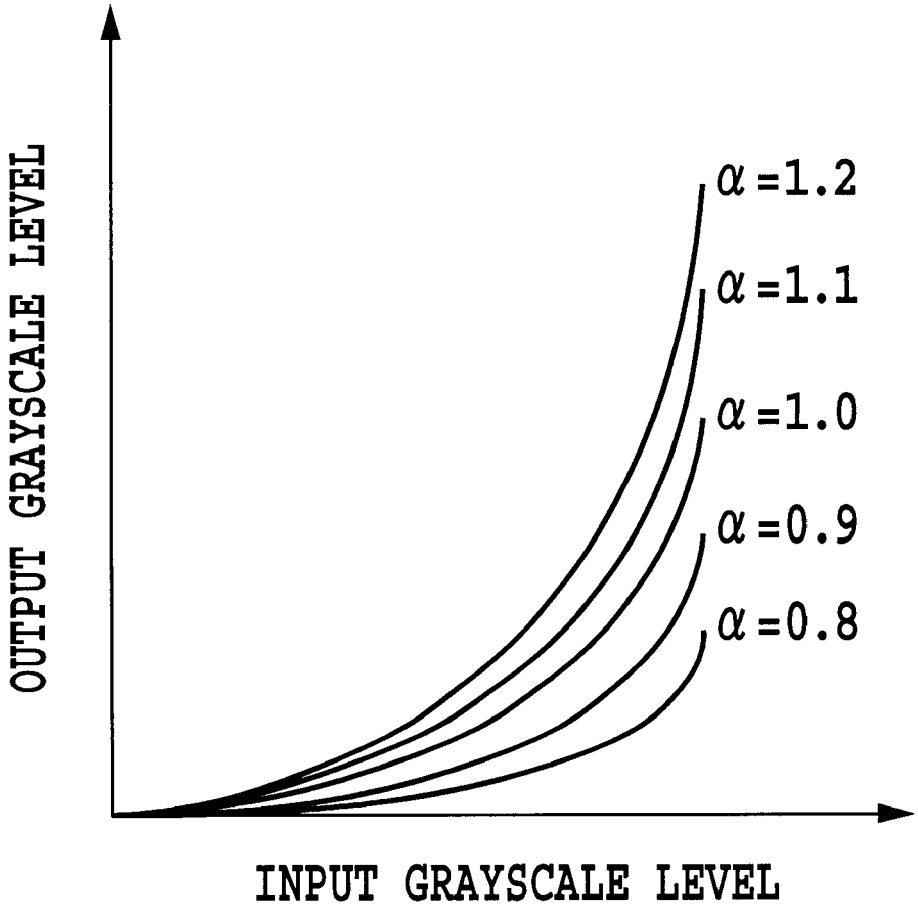
FIG. 19 is a diagram showing the content of an output γ correction table used in the second embodiment of the invention.

In the second embodiment also, the output $\gamma$ correction tables related with the correction values are stored in the RAM. That is, the output $\gamma$ correction curves, as shown in FIG. 19, that correspond to the correction values of 0.8, 0.9, 1.0, 1.1 and 1.2 are stored in the RAM as tables.

According to the correction value calculated, the corresponding correction table is selected for each nozzle. When the calculated correction value is 0.8, the print density will be 20% lighter than when no correction is made; and when the correction value is 1.2, the print density will be 20% darker.

In this way, in the second embodiment, the numbers of nozzles in the end nozzle blocks of the print head are set smaller than those in other nozzle blocks and the output densities of these nozzles are set to a predetermined value. Therefore, when density variations (striped variations) occur due to print medium feeding errors, as shown in FIG. 15B, the striped variations can be prevented by the reading and correction of the density variations, assuring a good quality image.

(Printing Operation)

The printing operation in this embodiment, as described above, involves processing the input print data according to the output $\gamma$ correction table, which was modified according to the nozzle characteristic, to generate print data and then performing printing on the print area based on the print data thus obtained.

In this second embodiment, too, the number of printing scans required to form the patch can be set arbitrarily. It is also possible to change the number of nozzles in each nozzle block. In the second embodiment, the nozzle blocks situated at the ends of the print head are made up of two nozzles each, with other nozzle blocks having four nozzles each. The number of nozzles in each nozzle block, however, can be changed as required. If desired, the end nozzle blocks may be constructed of a single nozzle each.

As described above, according to the embodiments of the invention, a nozzle array in the print head made up of a plurality of nozzles is divided into a plurality of nozzle blocks and each of the patches is each printed with only the nozzles of the same nozzle block allocated to the patch in such a dimension and shape that enables its density to be optically detected by the density sensor. Therefore, with this invention, it is possible to obtain an output characteristic of the print head by using an inexpensive, small density sensor rather than an expensive CCD scanner and, based on the output characteristic, realize the correction of the output density with low cost and ease. Thus, in constructing a printing apparatus with an output characteristic setting function, the application of this invention allows the apparatus as a whole to be constructed with low cost, permitting its personal use which is demanded of this kind of apparatus.

Further, by setting two or more nozzles as the number of nozzles making up each nozzle block, the density of the test pattern can be read faster and the correction of the output characteristic performed in a shorter length of time than when the test pattern density is read one line at a time as in the conventional method.

Further, by setting fewer nozzles as the number of nozzles making up the end nozzle blocks of the print head than the number of nozzles in other nozzle blocks and by setting the output densities of these nozzles to a predetermined value, it is possible to prevent density variations due to print medium feeding errors, further enhancing the quality of the printed image.

[Third Embodiment]

The third embodiment of this invention will be described by referring to the accompanying drawings. This embodiment has a mechanical construction similar to those of the preceding embodiments (see FIG. 1) and also has a print head as shown in FIG. 3 and a reflection type sensor as shown in FIG. 4.

Figure 21A:
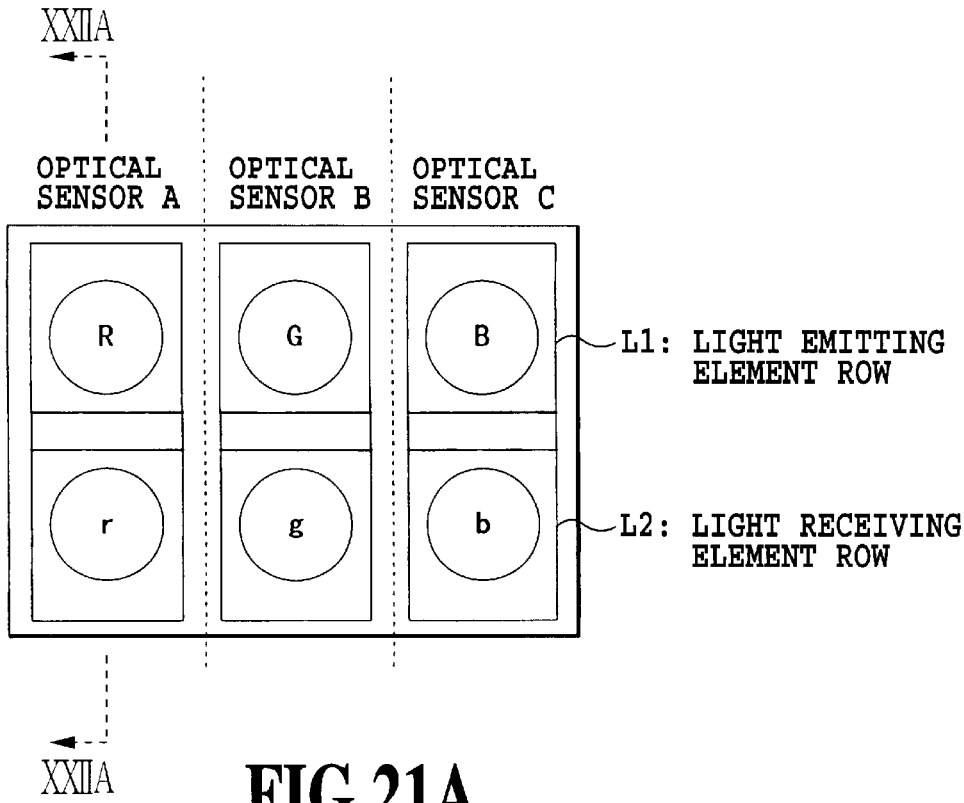
FIG. 21A is a plan of view of an outline configuration of a reflection type optical sensor in a third embodiment of the invention.

FIG. 21A shows an outline construction of the reflection type optical sensor used in this embodiment.

Figure 21B:
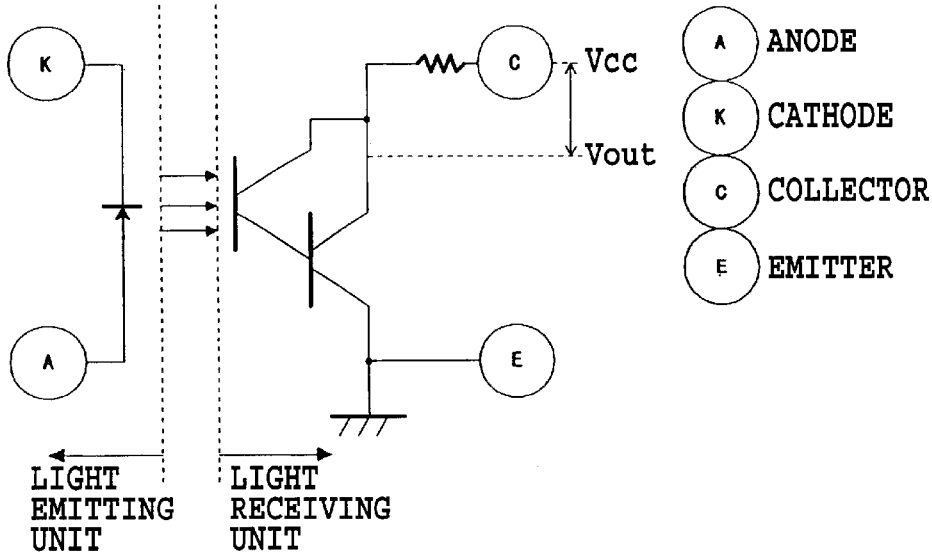
FIG. 21B is a circuit diagram of a reflection type optical sensor in a third embodiment of the invention.

The reflection type optical sensor 30 has three kinds of optical sensors A, B, C each incorporating a light emitting element 31 and a light receiving element 32. There are three kinds of light emitting element 31: a light emitting element R for emitting red light, a light emitting element G for emitting green light and a light emitting element B for emitting blue light. As the light receiving element 32, there are three kinds: r, g and b, each of which receives light of its own particular wavelength. The light emitting element and the light receiving element are arranged to oppose each other in each optical sensor A, B, C. A combination of the light emitting element and the light receiving element is (R, r) for the optical sensor A and (G, g) for the optical sensor B and (B, b) for the optical sensor C. The light emitting elements are arranged in line Ll and the light receiving elements are also arranged in line L2. The light emitting elements R, G, B as a whole are referred to as a light emitting unit (or "light emitting element") 31, and the light receiving elements r, g, b as a whole are referred to as a light receiving unit (or "light receiving element") 32. The optical sensors A, B, C each have a circuit configuration shown in FIG. 21B. The light emitting unit is a photo diode and the light receiving unit is formed of a Darlington photo transistor.

Figure 22A:
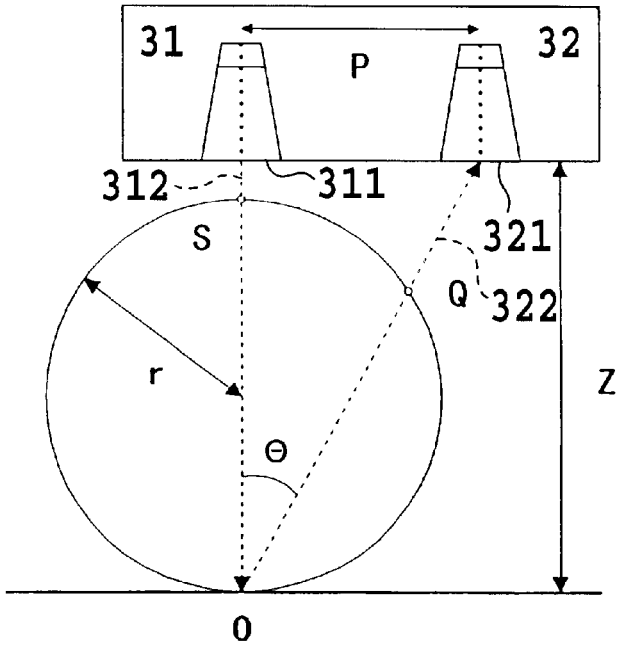
FIG. 22A is a cross section taken along the line I—I of FIG. 21, representing a case of complete diffusion reflection.
Figure 22B:
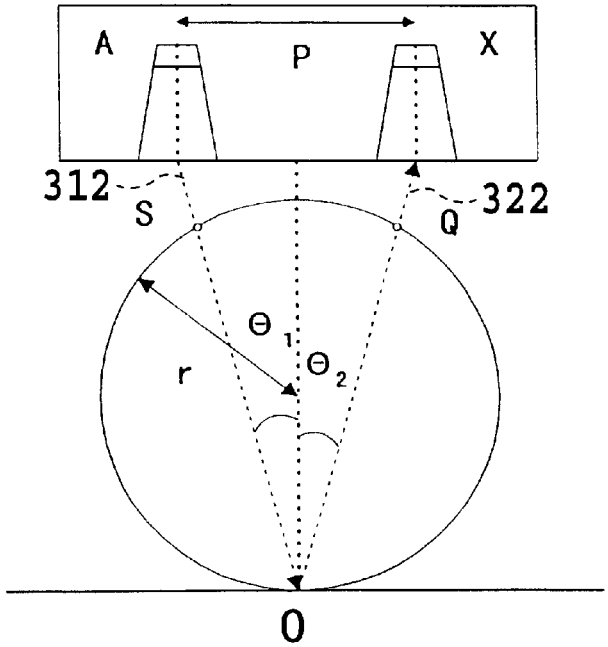
FIG. 22B is a cross section taken along the line I—I of FIG. 21, representing a case where a light emitting element and a light receiving element are arranged at an angle.

FIG. 22A and FIG. 22B show the relation between the I—I cross section of the optical sensor and the flow of light.

FIG. 22A is a diagram showing the flow of light in the case of complete diffusion reflection. An angle θ formed by an incident line 312 extending vertically from a chip lens 311 of the light emitting element 31 and a reflection line 322 connecting a base point O, which is at an intersection between the incident line 312 and the reflection plane, and a chip lens 321 of the light receiving element 32, is expressed by $$\theta = tan^{-1}(P/Z)$$

where P is a distance between the light emitting element 31 and the light receiving element 32 and Z is a distance from the chip lens to the reflection plane.

If a reflected light intensity at the intersection S between the circumference of a radius r and the incident line 312 is 1, a reflected light intensity R at the intersection Q between the circumference and the reflection line 322 is given by $$R = (1 \times cos\theta) < 1$$

The reflected light intensity R is weaker than the reflected light intensity on the incident line 312 side. This means that there is some loss of the reflected light intensity.

The objects to be measured by the optical sensor of this embodiment are basically diffusion reflection objects. These are considered to produce Lambert reflections. Hence, to prevent a loss of reflected light intensity and produce reflected light with a high efficiency, it is ideal to arrange the light emitting and receiving elements 31, 32 on the same axis but this arrangement is difficult to achieve. Thus, arranging the light emitting element 31 and the light receiving element 32 at an angle to the incident line can minimize the loss of the reflected light intensity.

FIG. 22B shows an arrangement in which the light emitting element 31 and the light receiving element 32 are each put at an angle to the incident line.

The light emitting element 31 and the light receiving element 32 are arranged at an angle so that $\theta = \theta_2$ where $\theta_1$ is an angle between the incident line 312 and the vertical line and $\theta_2$ is an angle between the reflection line 322 and the vertical line. This arrangement can reduce the loss of the reflected light intensity. In this embodiment, the optical sensors A, B, C all have the construction shown in FIG. 22B.

The optical sensors have a simple construction with some loss of reflected light intensity, so their resolutions are coarser than that of the scanner. While the scanner is capable of discriminating images in units of dot, the optical sensor cannot make such a distinction. Thus, in this invention, a pattern of a readable size is printed on the print medium in units of nozzle of the print head or in units of nozzle block, each consisting of a plurality of nozzles, and the printed pattern is measured to detect the print characteristic for each nozzle or for each block. Although in this embodiment the pattern size is 70 dots by 70 dots, any other appropriate size can be set according to the function of the optical sensor.

Next, how the reflectivity varies from one ink (colorant) kind to another will be explained.

The reading sensitivity or reflectivity of the optical sensor changes according to the ink color of an image to be read.

Figure 23A:
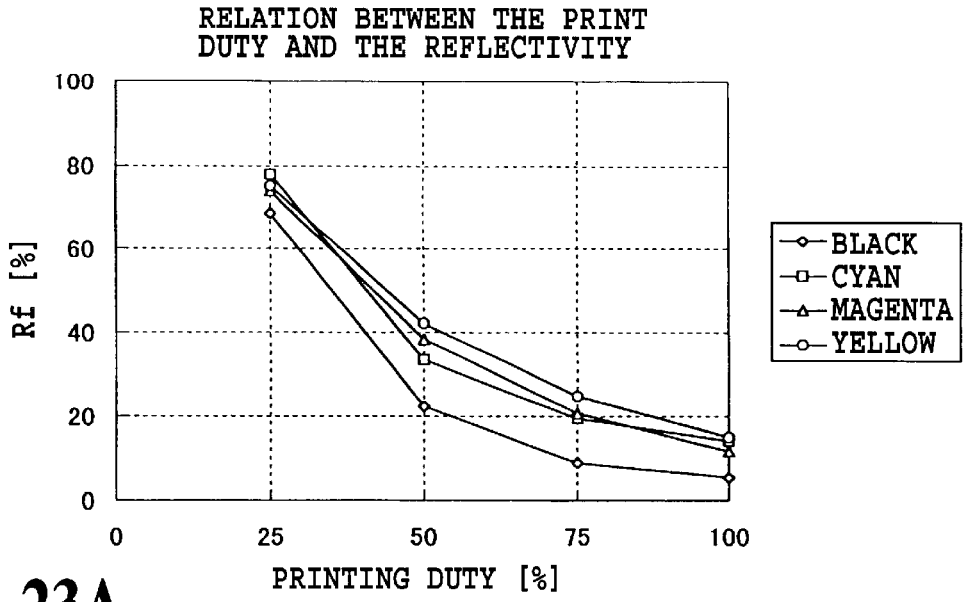
FIG. 23A is a graph showing a relation between a printing duty and a reflection rate.

FIG. 23A is a diagram showing a relation between the print duty and the reflectivity.

FIGS. 23B, 23C, 23D and 23E show dot arrangements in a predetermined area when the printing duty is 25%, 50%, 75% and 100% respectively.

Figure 23B:
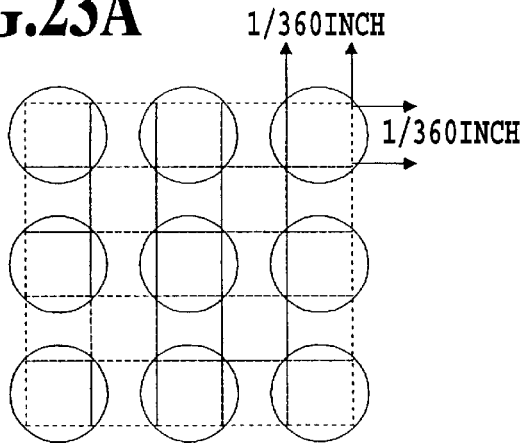
FIGS. 23B, 23C 23D and 23E are printed patterns showing a predetermined range of dots when the printing duties are 25%, 50%, 75% and 100%, respectively.
Figure 23C:
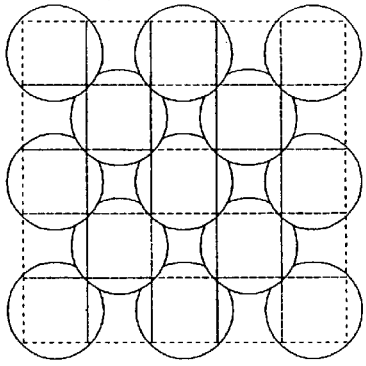
Figure 23D:
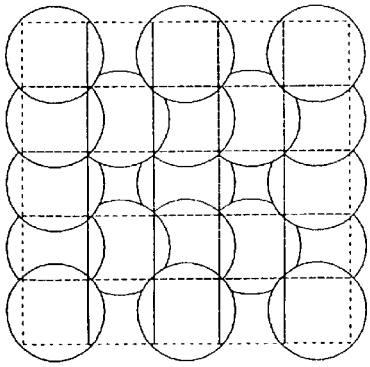
Figure 23E:
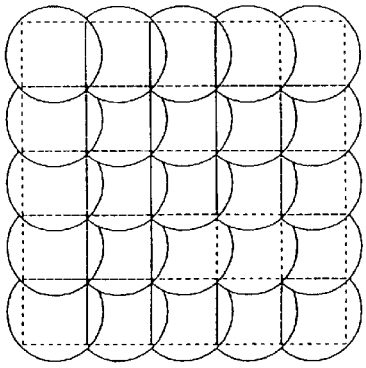

For all colorants, the reflectivity tends to decrease as the printing duty increases. That is, in the half-tone patterns with low printing duties or low area factors as shown in FIGS. 23B and 23C, there is a large blank area which easily reflects light. In patterns with high printing duties as shown in FIGS. 23D and 23E, the blank area is small, so the light cannot easily be reflected. In a printed state with a printing duty of less than 50%, the change in the blank area is proportional to the change in the density and therefore the relation between the printing duty and the reflectivity is almost linear.

In a printed state with a printing duty of more than 50%, the density varies due to the overlapping of dots and the fluctuating amount of ink applied, so that the relation between the reflectivity and the printing duty is not linear, with the reflectivity tending to decrease relatively moderately. That is, when the printing duty exceeds 50%, the rate at which the reflectivity decreases becomes small as the printing duty increases.

Figure 24:
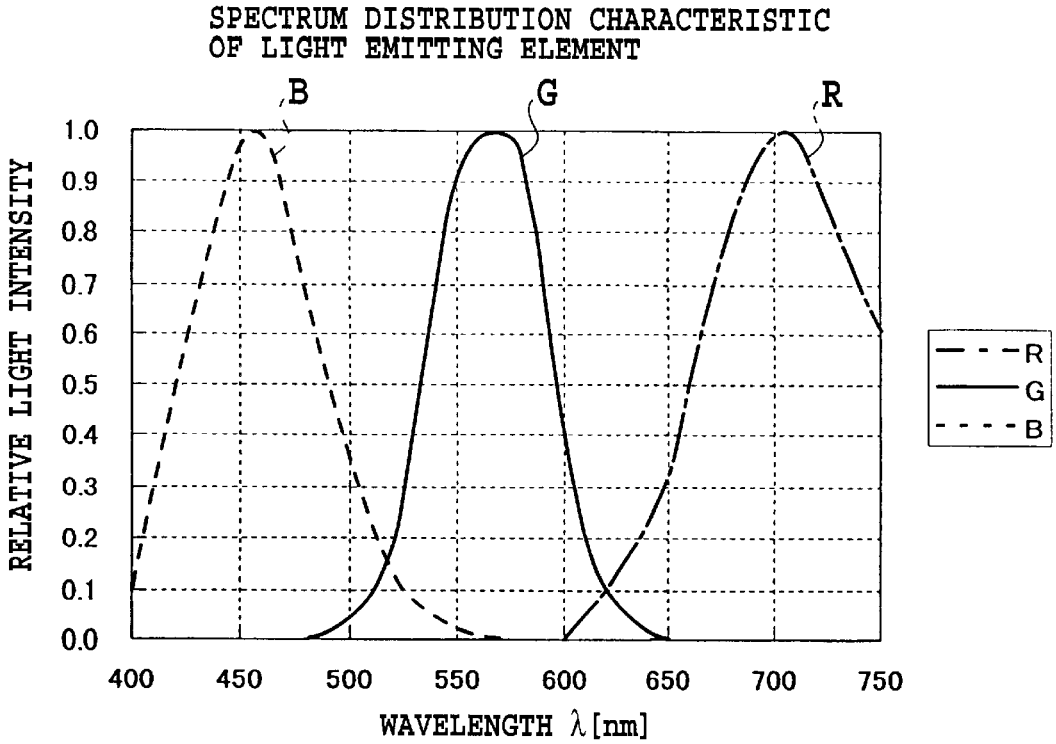
FIG. 24 is a diagram showing spectrum distribution characteristics of light emitted from the light emitting elements R, G, B.

FIG. 24 is a diagram showing spectrum distribution characteristics of light emitted from the light emitting elements R, G, B.

As described above, the light from the light emitting elements R, G, B is red, green and blue, and their peak wavelengths are 700 (nm), 565 (nm) and 455 (nm), respectively. The printing apparatus of this embodiment uses four colorants, black, cyan, magenta and yellow. Hence, if the light is emitted by the light emitting element that has a light emitting wavelength range overlapping the light absorbing wavelength range of the pattern formed with each colorant, the reflected light intensity changes along with the density.

Figure 25:
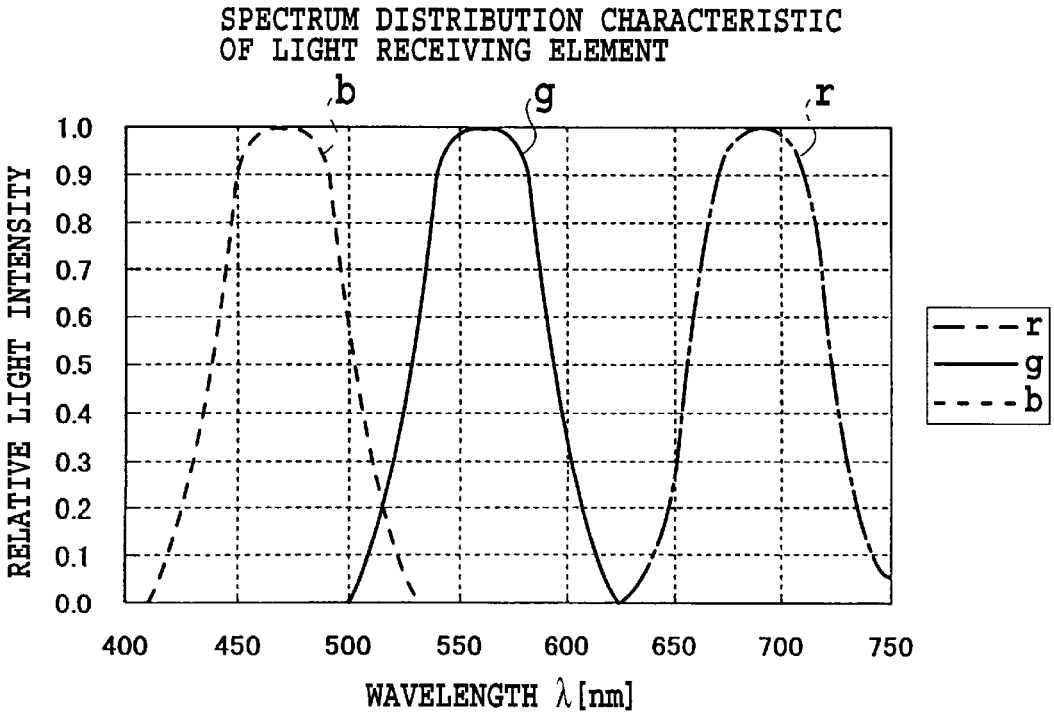
FIG. 25 is a diagram showing spectrum sensitivity characteristics of light receiving elements.

FIG. 25 is a diagram showing spectrum sensitivity characteristics of light receiving elements.

The lens of each light receiving element is made of a resin containing a dye to block light of other than a specified wavelength range. In the case of the light receiving element r, for example, the lens is formed of a resin containing a dye that exhibits no sensitivity for light of a wavelength shorter than 600 (nm). By combining the light receiving element r with a red light emitting element R, the light receiving element receives only the light in the wavelength range of 650–730 (nm). Similarly, the light receiving elements g, b also have spectrum wavelength ranges overlapping the light emitting wavelength ranges of the light emitting elements G, B. So, they can receive only the light in the predetermined wavelength ranges and produce outputs with high sensitivity.

FIG. 26 and FIG. 27 show light absorbance distribution characteristics for colorants.

These light absorbance distribution characteristics are obtained by printing on plain paper patterns with printing duty of 100%, radiating light from the respective light emitting elements R, G, B, and measuring the reflectivities of the patterns. The patterns are each formed of a single corresponding colorant.

Figure 26A:
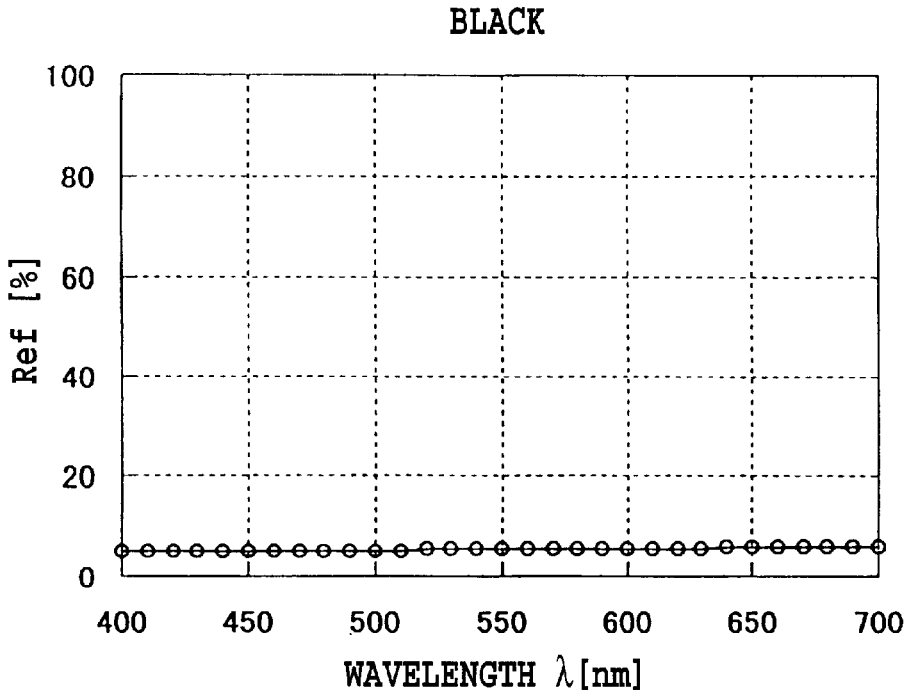
FIG. 26A is a diagram showing light absorbance distribution characteristic for a black colorant.
Figure 26B:
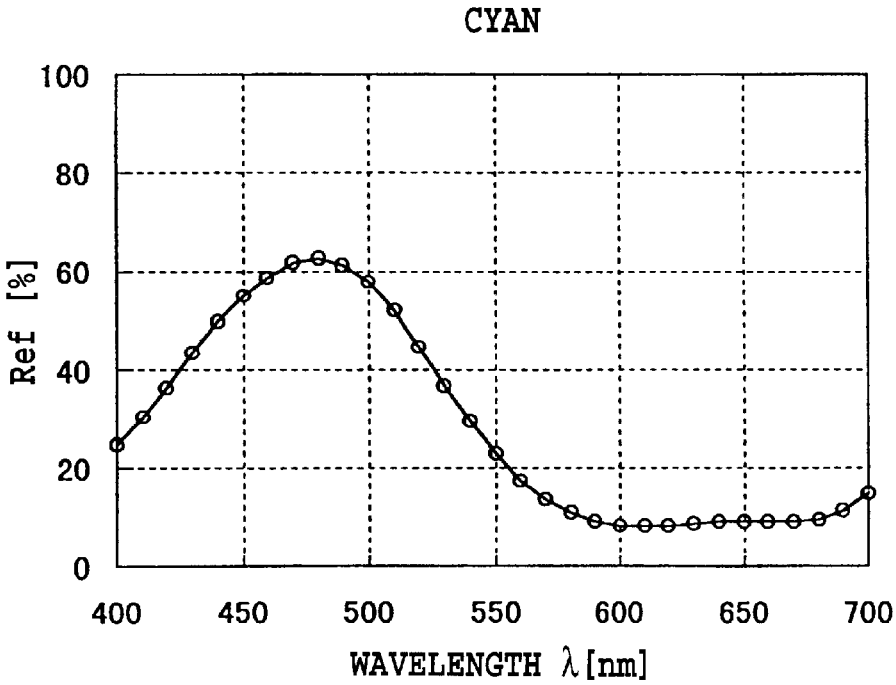
FIG. 26B is a diagram showing light absorbance distribution characteristic for a cyan colorant.
Figure 27A:
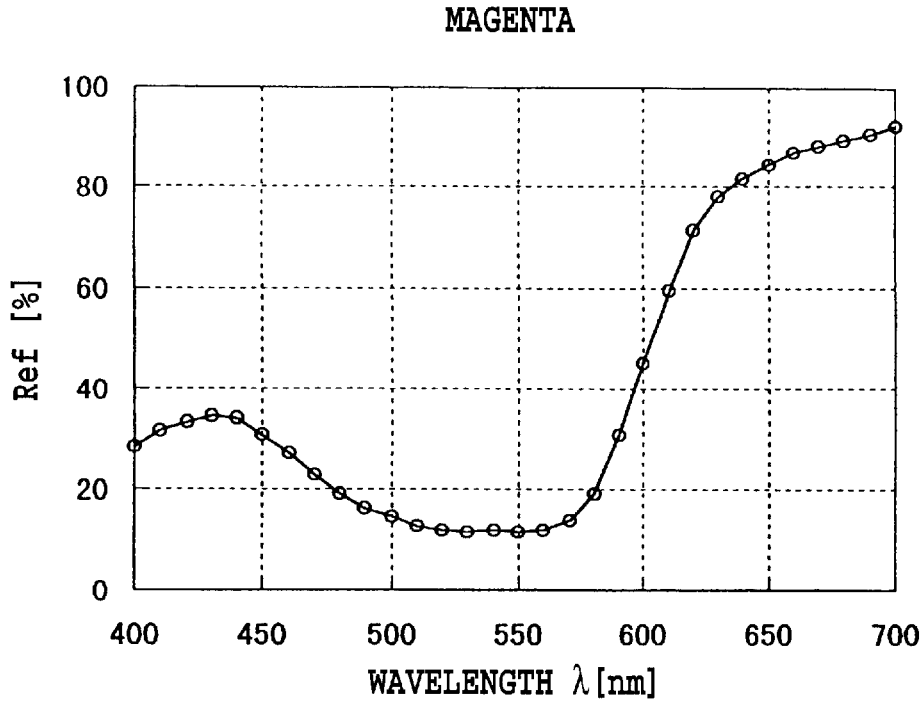
FIG. 27A is a diagram showing light absorbance distribution characteristic for a magenta colorant.
Figure 27B:
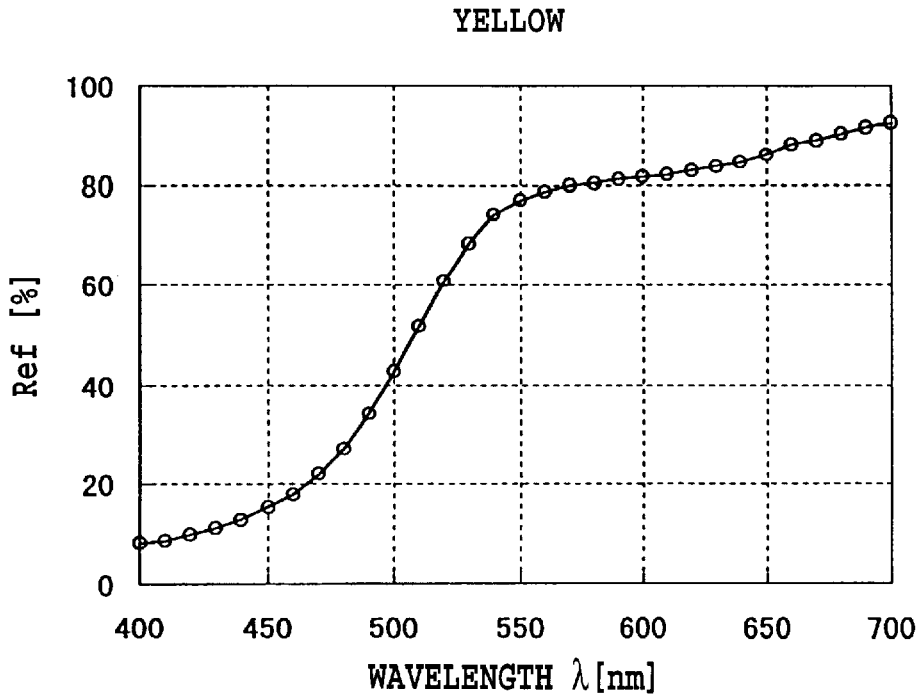
FIG. 27B is a diagram showing light absorbance distribution characteristic for a yellow colorant.

In the figures, the abscissa represents a wavelength $\lambda$ and the ordinate represents a reflectivity Ref. As shown in FIG. 26B, cyan exhibits the light absorbance distribution characteristic in a wavelength range of 580–700 (nm). As shown in FIGS. 27A and 27B, magenta and yellow exhibit the light absorbance distribution characteristics in wavelength ranges of 500–580 (nm) and 400–470 (nm), respectively. Black exhibits the light absorbance distribution characteristic in almost the entire wavelength range measured, as shown in FIG. 26A. Therefore, it is effective to illuminate the cyan pattern with light from the light emitting element R, the magenta pattern with light from the light emitting element G, and the yellow pattern with light from the light emitting element Y. For a pattern formed with a black ink, any light emitting element may be used for measurement because the black ink pattern exhibits the light absorbance characteristic over almost the entire wavelength range of the three light emitting elements R, G, B used in this embodiment.

Figure 28:
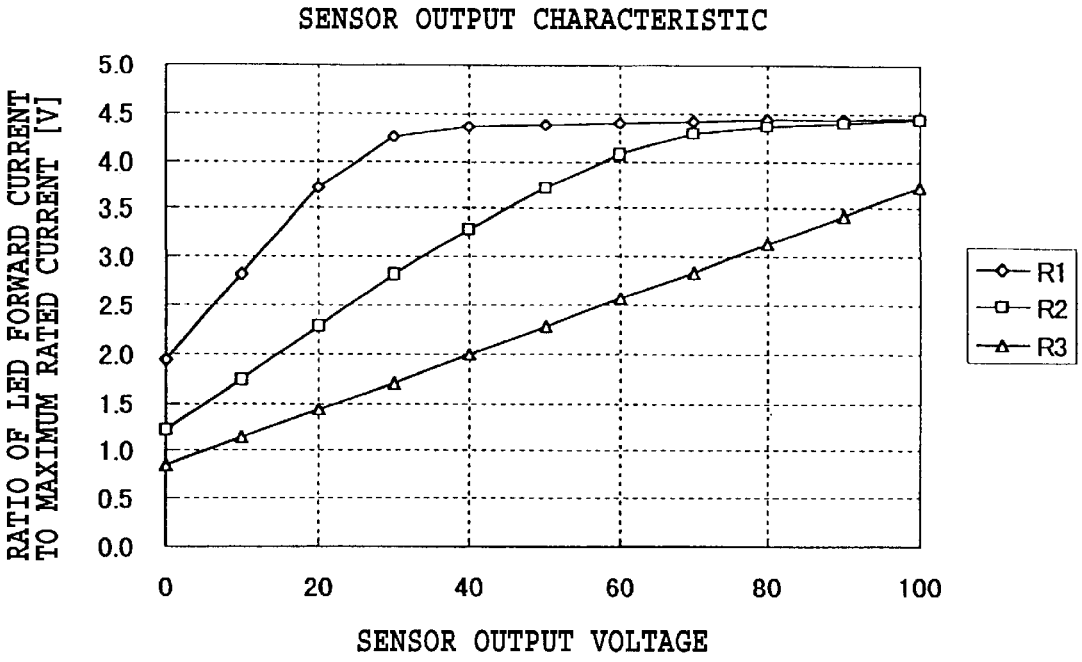
FIG. 28 is a graph showing a sensor output characteristic when the printed pattern is illuminated by changing a forward current of the light emitting element.

FIG. 28 shows output characteristics obtained by fitting light emitting elements with different sensitivities to optical sensors used in this embodiment, printing a pattern with a printing duty of 50% on plain paper with a black ink, and illuminating the printed pattern with light from the light emitting elements from the same distance by changing forward currents supplied to the light emitting elements. In the figure, the abscissa represents a ratio of the forward current supplied to the light emitting element to the rated maximum value taken as 100%, and the ordinate represents a sensor output voltage. The optical sensor normally has mounting tolerances and electrical characteristic variations. Thus, even with the same forward current, the sensor output characteristic will vary greatly. In the case of a sensor R1, the sensor output voltage is saturated for the forward current of 50% or higher. Thus, in a high reflectivity area with the printing duty of 50% or less it is difficult to detect a density change. In an area with the printing duty of 50% or more where the reflected light intensity decreases, the R1 sensor can discriminate a density difference with a higher sensitivity than the R3 sensor. Thus, by activating the optical sensor under the condition suited for the density range being checked, the density variations can be detected with high precision.

Now, the method of detecting the characteristic of the print head by using the above-described reflection type optical sensor and then correcting the density variations will be described.

Figure 29:
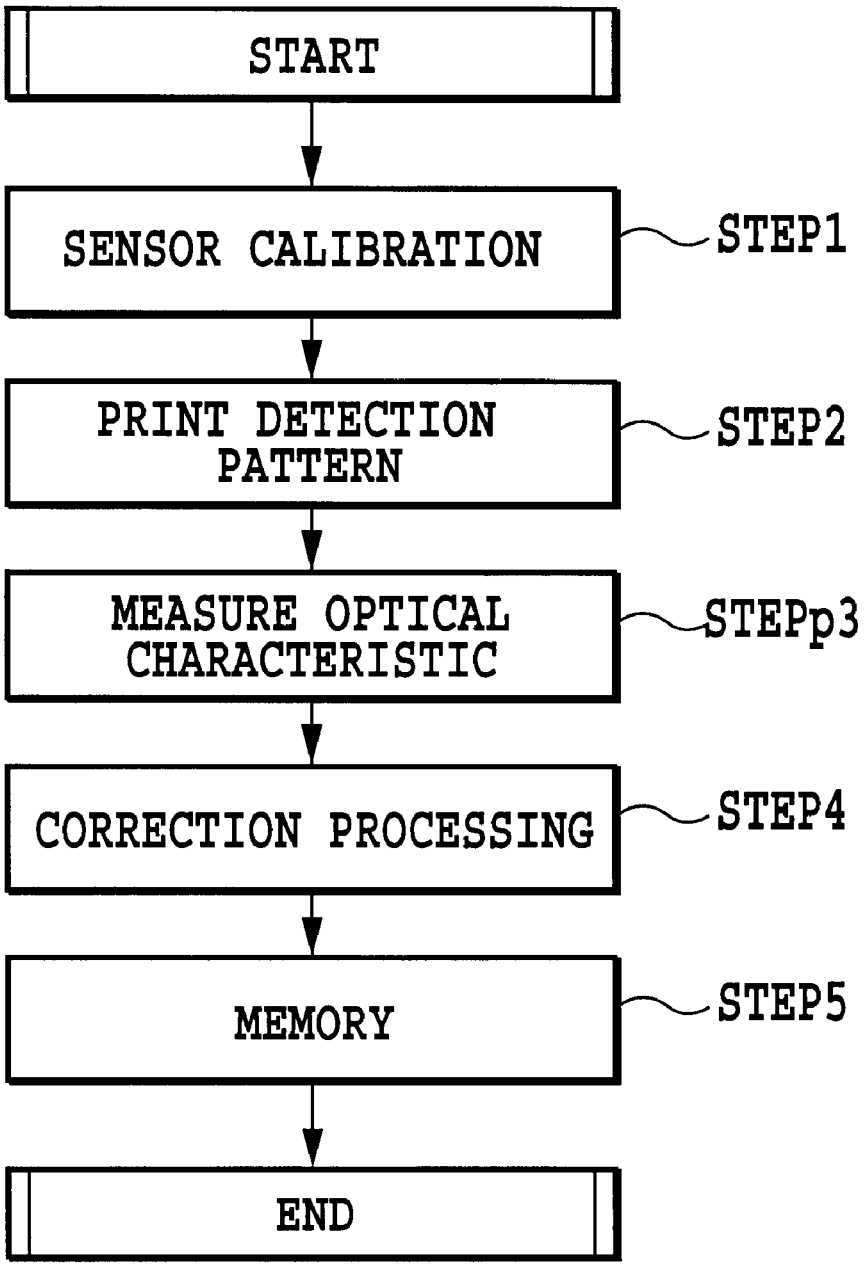
FIG. 29 is a flow chart showing density information obtaining processing.

FIG. 29 is a flow chart of density information determining processing.

Because the amount of light to be applied differs from one tone to another, a calibration is first executed to correct light intensity variations of the optical sensor itself and determine an appropriate amount of light to be applied in order to ensure that a proper amount of light is radiated against the printed pattern being checked (step 1). This calibration processing will be detailed later.

Next, a print pattern for detecting density variations, like the one shown in FIGS. 23A to 23E, is printed on a print medium (step 2). A print pattern of a predetermined size may be printed by only a single nozzle or by a nozzle block having a plurality of nozzles. The nozzle block used for the pattern printing is formed as follows. The print head is divided into blocks of, for example, 16 nozzles each and one of the nozzle blocks is used for printing the print pattern. The print pattern is not limited to the above-described pattern. The print pattern, when it is formed by a nozzle block of 16 nozzles for example, may be formed in a single pass or in multiple passes as required.

Next, the optical characteristic of the print pattern is measured by the optical sensor (step 3). From the measured data, correction information is determined for each nozzle or for each block (step 4). The procedure for determining the correction information will be described later. The correction information is then written into an EEPROM (not shown) provided on the printed circuit board of the printing apparatus (step 5) and the processing is terminated.

Now, the calibration processing at step 1 will be explained. This calibration processing modulates the value of the forward current applied to the optical sensor to correct the sensitivity by a resulting change in the sensor output voltage. Because the light emitting element with good sensitivity changes according to the tone of the ink, this embodiment has a plurality of optical sensors. This calibration processing is performed on each optical sensor for each color.

Figure 30:
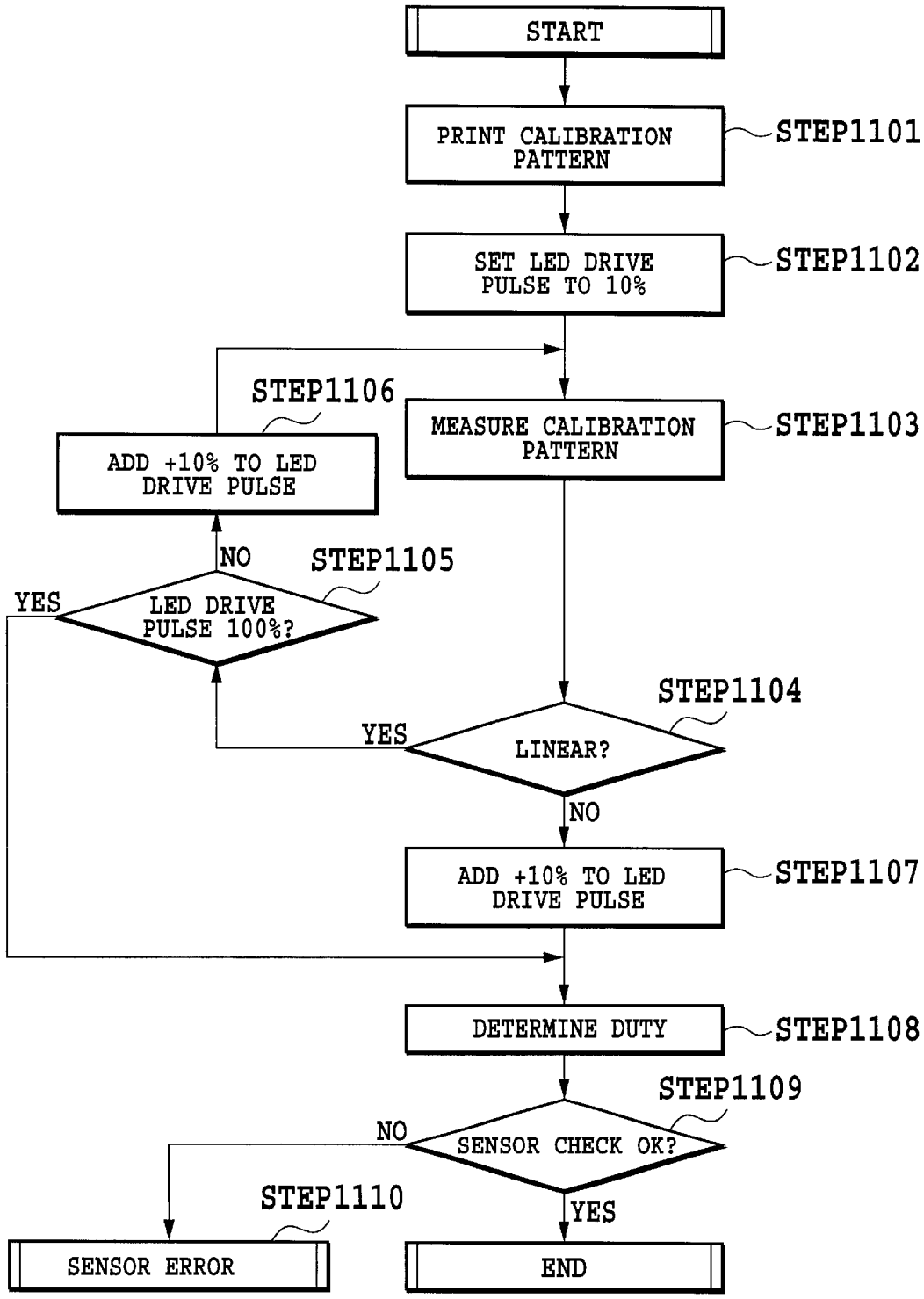
FIG. 30 is a flow chart showing calibration processing.

FIG. 30 is a flow chart showing the calibration processing.

Figure 31A:
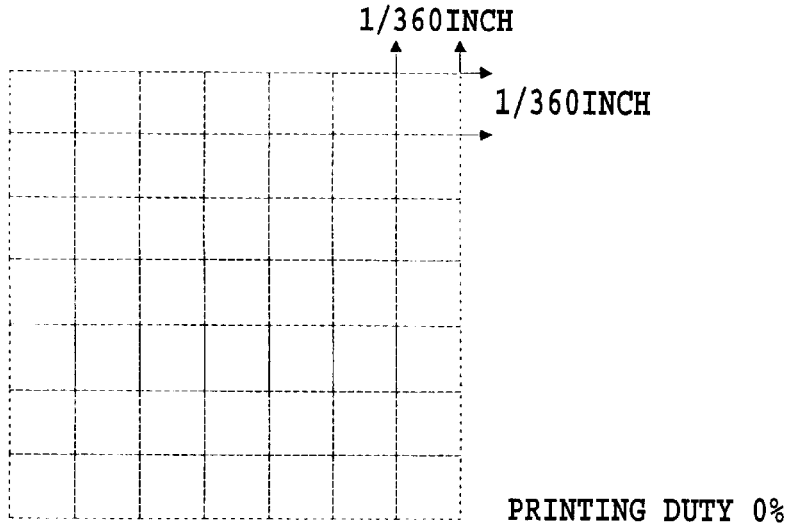
FIG. 31A is an example of calibration pattern representing a case where the printing duty is 0%.
Figure 31B:
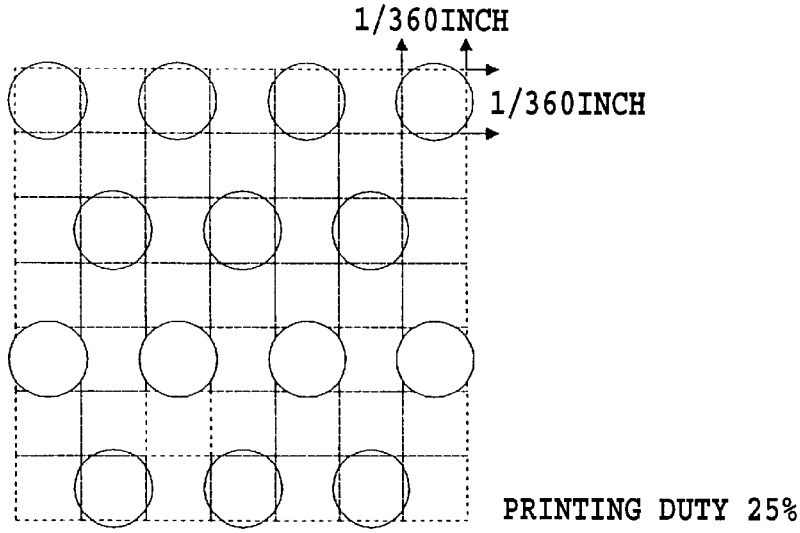
FIG. 31B is an example of calibration pattern representing a case where the printing duty is 25%.
Figure 31C:
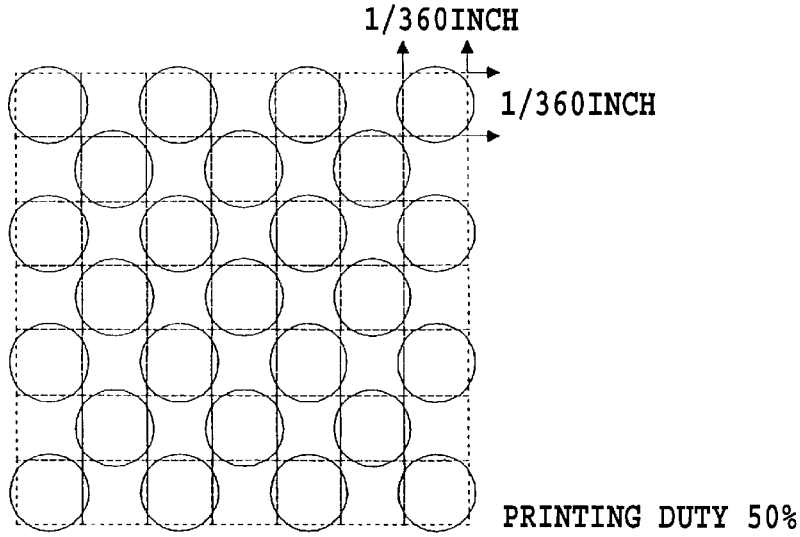
FIG. 31C is an example of calibration pattern representing a case where the printing duty is 50%.

First, calibration patterns with printing duties of 0% (see FIG. 31A), 25% (see FIG. 31B) and 50% (see FIG. 31C) are printed on a print medium with an ink whose tone is in a range covered by the density variation correction (step 1101). This embodiment considers the density correction for the printing duty of up to 50% and therefore only the calibration pattern with the printing duty of up to 50% is printed. The invention, however, is not limited to this printing duty. Next, the pulse width of a drive signal to the light emitting element is modulated by a pulse width modulation (PWM) control to set the pulse width to a value equivalent to 10% of the maximum rated current (step 1102). Then, the density of the calibration pattern printed by step 1 is measured (step 1103). It is checked whether the measured value is linear or not (step 1104). If it is linear, a check is made to see if the drive pulse width has reached 100% of the maximum rated current (step 1105). If the drive pulse width has not, the pulse width is increased by another 10% (step 1106) and the processing from the step 1103 down on is executed. In this way, the processing from step 1103 to step 1106 is repeated. When at step 1104 the measured value is found to be no longer linear, the drive pulse width is reduced by 10% (step 1107) and the resulting width is determined as the drive pulse width (step 1108). When at step 1105 the drive pulse width is found to have reached 100% of the maximum rated current, the addition can no longer be performed and at this point the processing moves to step 1108 where it determines the drive pulse width.

Then, the sensor is activated by the determined drive pulse width to execute the sensor check processing (step 1109). The sensor check processing checks whether density variations cannot be detected due to sensor failure, by actually measuring the calibration patterns with the printing duties of 0% and 50%, calculating a difference between the two output results, and deciding whether the difference is higher than a predetermined threshold value. When the density variation cannot be detected, as when the reflected light intensity does not change, the difference is below the threshold value. This state is decided as a sensor error (step 1110).

While this embodiment increases the drive pulse width in increments of 10% of the maximum rated current, the adjustment may be made in smaller increments.

Figure 32:
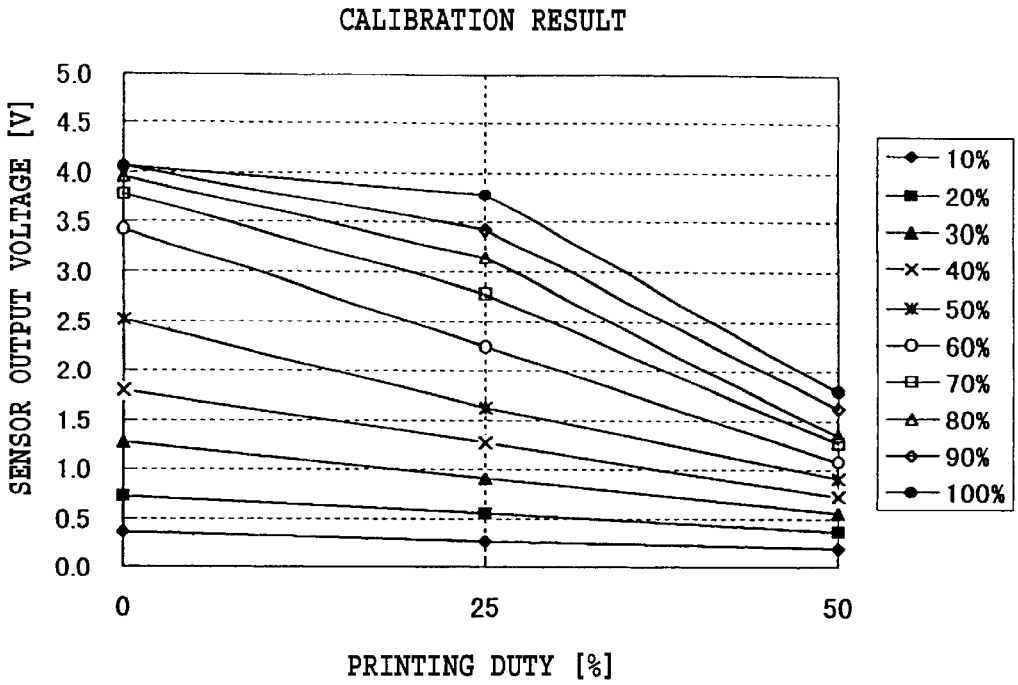
FIG. 32 is a graph showing a result of calibration.

FIG. 32 shows an example result of calibration (for the case of the light emitting element R and the light receiving element r).

The abscissa represents the printing duty of the calibration pattern and the ordinate represents a sensor output voltage, i.e., a voltage value into which the amount of reflected light received by the light receiving element has been converted.

If the sensor output characteristic is linear in the printing duty range of between 0% and 50% and has a predetermined inclination, it is possible to detect a slight density change when the pattern with any printing duty is read. When the drive pulse width is, for example, 10% of the maximum rated current, there is almost no output change in the printing duty range of 0–25% as shown in the figure and this output characteristic is not suited for practical use. When the drive pulse width is the maximum rated current, too, there is almost no output change and this output characteristic is not suited for practical use. It is when the drive pulse width is 50% of the maximum rated current that the sensor output characteristic is linear and its inclination is greatest. The use of this output characteristic for the actual measurement of the density variations can produce an appropriate output value.

Next, the density variation detection and correction processing will be described.

FIGS. 33A to 33D are schematic diagrams showing patterns used for detecting density variations.

Figure 33A:
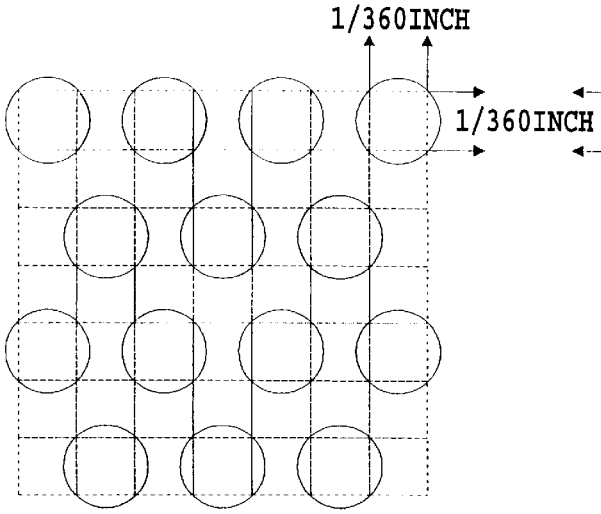

In order to reflect the characteristic of a block consisting of a plurality of nozzles on an optical characteristic of a predetermined pattern, the detection pattern should preferably be a pattern with a half-duty (50% printing duty), for example, a stagger pattern shown in FIG. 33A. The reason for this is that the size and shape of dots significantly affect the area coverage of the patch, i.e., a percentage indicating how much of that area on the print medium which needs to be printed is covered with the printed dots. The area coverage of the patch is also referred to as an area factor.

Figure 33B:
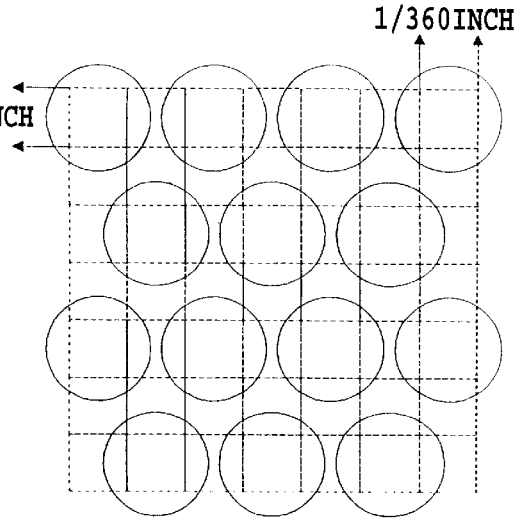
Figure 33C:
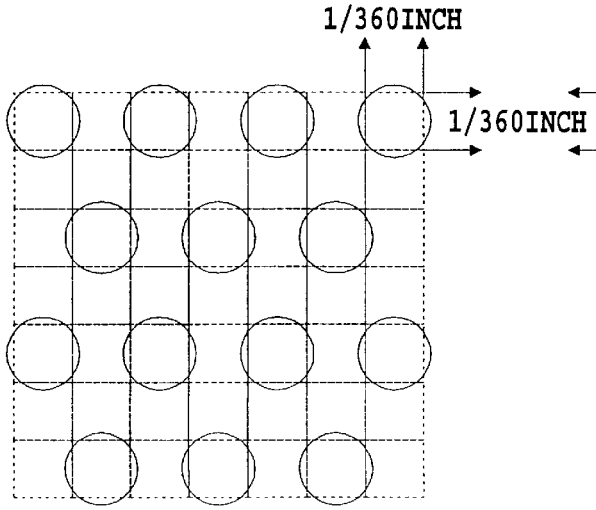
Figure 33D:
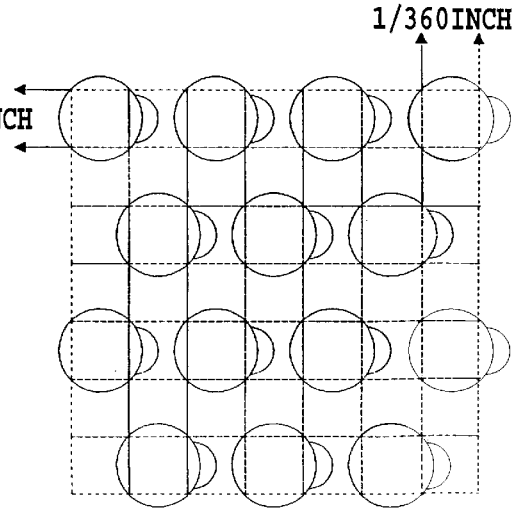

FIGS. 33B, 33C and 33D are printed in the same scan direction as FIG. 33A but with different amounts of ink and at different ejection speeds, the ink ejection amount and ejection speed constituting the factors of density variations. FIG. 33B is a printed result when the amount of ink ejected is 10% more than the specified amount and FIG. 33C is formed by ejecting 10% less ink. FIG. 33D represents a pattern that is printed with a specified amount of ink but at a 10%-faster ejection speed than the specified speed. It should also be noted that a main droplet and a sub-droplet (satellite) are deviated in position from each other. In this way the size of the dots formed can vary according to an increase or decrease in the amount of ink ejected and therefore the density of the pattern itself also changes. When the ejection speed increases, the landing errors between the main droplet and the sub-droplet become large, increasing the area factor.

Figure 34:
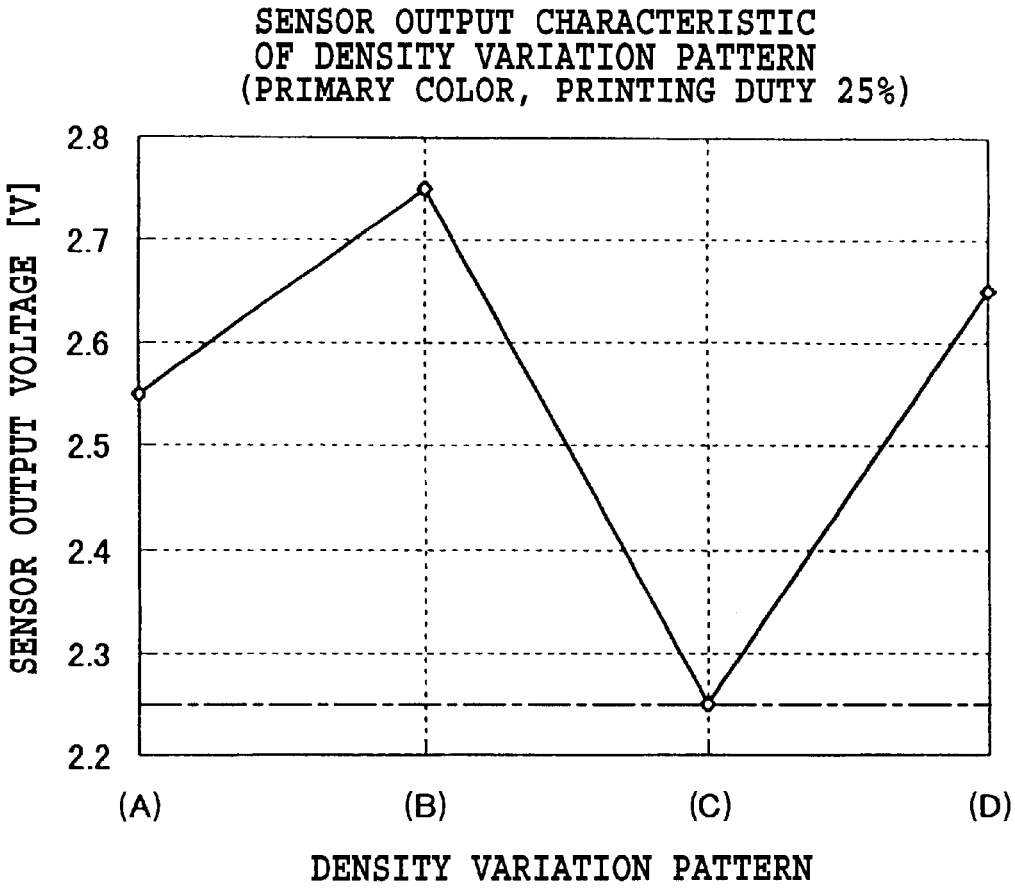
FIG. 34 is a graph showing an output value of the optical sensor when it reads the printed pattern with the printing duty of 50%.

FIG. 34 is a graph showing the output of an optical sensor that actually read the patterns of FIGS. 33A to 33D.

The output value of the optical sensor is proportional to the amount of reflected light. That is, it is inversely proportional to the density (area factor) of the detection pattern. In this embodiment, when the actual ejection amount is smaller than the specified ejection amount (for example, in the case of FIG. 33C), the output value is increased. When the actual ejection speed is larger than the specified ejection speed (for example, in the case of FIG. 33D), the area factor increases and thus the output value decreases.

As described above, the pattern of a predetermined size formed by using a predetermined nozzle or a predetermined nozzle block consisting of a plurality of nozzles is read by the optical sensor and, according to the output value of the sensor, the correction is done. Now, the density variation correction processing performed when the patterns printed by the predetermined nozzles are FIGS. 33B, 33C and 33D will be explained.

In this embodiment, the output values for each patch are divided by the smallest output value to calculate Vref values and, based on the Vref values, the correction values are calculated.

FIG. 34 shows sensor output values for FIGS. 33A, 33B, 33C and 33D, with the lowest level indicated by a broken line.

Figure 35:
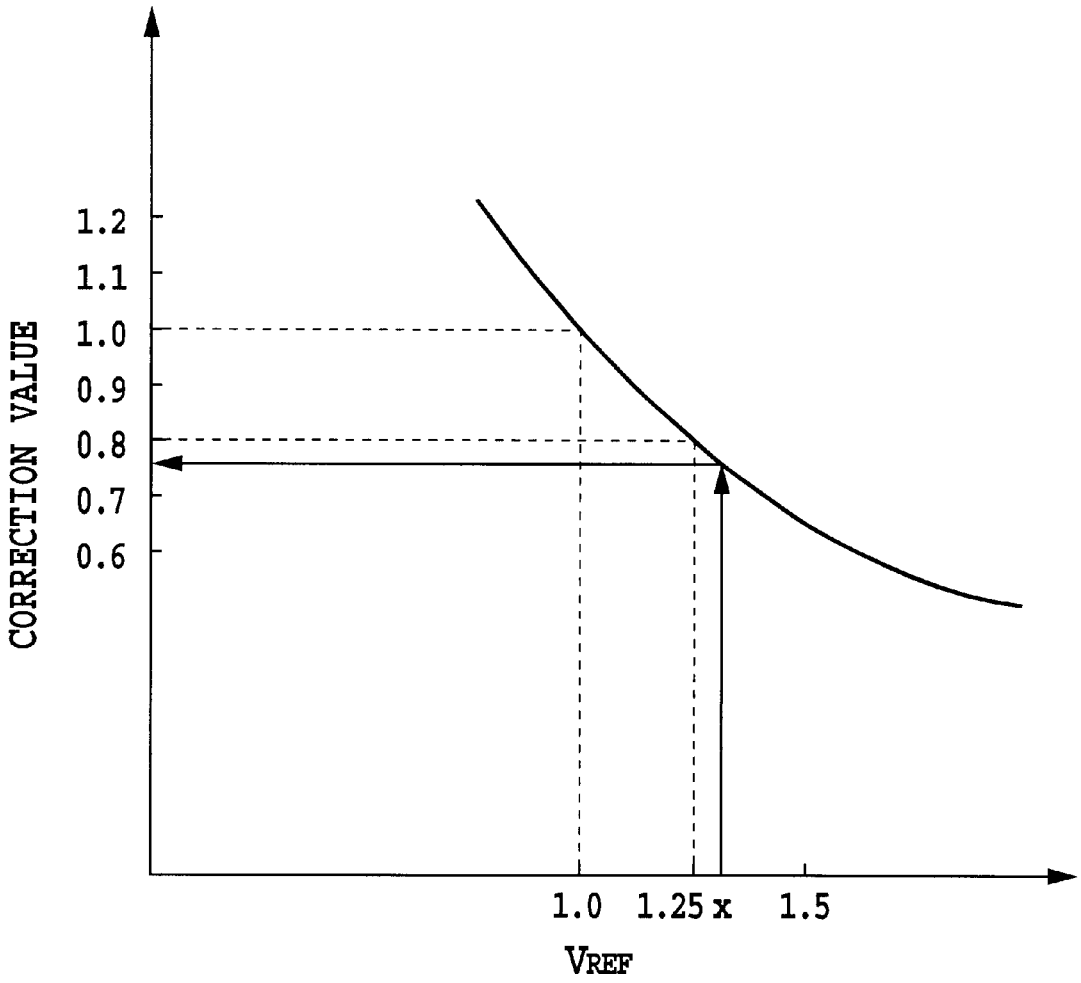
FIG. 35 is a curve showing a relation between a Vref value and its corresponding correction value.

FIG. 35 shows a curve representing a relation between a Vref value and its corresponding correction value. An appropriate correction value for the Vref value can be obtained according to this curve. That is, if the Vref has a value indicated by X in the figure, the corresponding correction value $\alpha$ determined from the curve is between 0.8 and 0.7. In this embodiment, the correction value obtained is rounded off to one decimal place. In this way, the correction value a corresponding to the Vref value is assigned a value ranging from 1.0 to 0.6. FIG. 36 is a table of correction values for FIGS. 33A, 33B, 33C and 33D that are determined from the curve of FIG. 35.

The curve (conversion curve) of FIG. 35 determining the relation between the Vref value and the correction value is an inversely proportional curve passing through a point which has a correction value of 1.0 when Vref=1.0.

Based on the correction value a set as described above, an output γ correction table stored beforehand in ROM is selected for each nozzle or for each nozzle block. Then, a density value corresponding to the print density value is read out from the output γ correction table.

Figure 37:
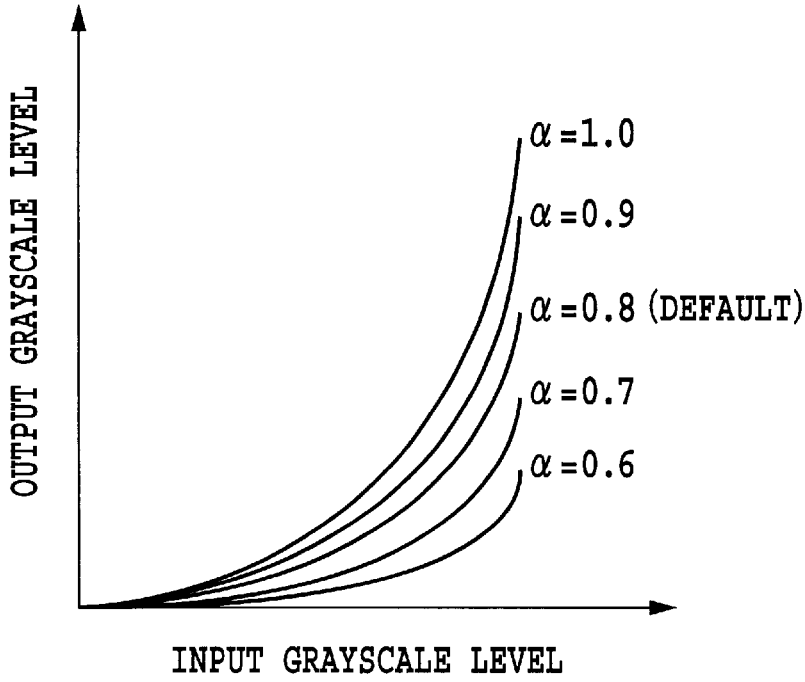
FIG. 37 is a graph showing a output γ correction table corresponding to the correction values of FIG. 36.

FIG. 37 is output γ correction tables in this embodiment.

An output γ correction table is set for each correction value shown in FIG. 36 and they are stored in the RAM. When the correction value α is 0.8 for example, the print density obtained from the output γ correction table selected from the correction value is 20% lighter than when the density is not corrected by the correction value.

Other methods of correcting the density variations may be employed. For example, some thermal ink jet type print heads is driven by the PWM control that uses a double pulse as a pulse applied to the heating body. When the sensor output voltage exceeds the reference (for example, in the case of pattern B and D), a pre-pulse is made shorter than the reference pulse width to reduce the amount of ink ejected. When on the other hand the sensor output voltage is lower than the reference (for example, in the case of pattern C), the pre-pulse is made longer than the reference pulse width to increase the ejection amount. In this way, the ejection pulse is changed to correct the amount of ink ejected from the nozzle to an appropriate value. This can also correct the density variations.

Because the print pattern is measured by using a relatively inexpensive optical sensor and the correction is automatically performed according to the result of measurement, not only can the density variation correction processing be executed without using an expensive input device such as scanner but the cost of the apparatus can also be kept relatively low.

[Fourth Embodiment]

In the third embodiment the printing apparatus measures a print pattern by using an optical sensor having three light emitting elements with different spectrum characteristics. In the fourth embodiment we will explain about a printing apparatus using an optical sensor having only one light emitting element.

In this embodiment, it is assumed that the optical sensor 30 has only a green light emitting element.

The three colors of black, cyan and magenta have overlapping light absorbance characteristics and are partially included in the spectrum distribution range of the green light emitting element. Therefore, the print patterns printed with these three color inks can be measured. A print pattern printed with a yellow ink, however, cannot be measured because yellow is not included in the spectrum distribution range of green. Thus, in this embodiment, yellow is overlapped with another color to generate a secondary color included in the spectrum distribution range of green, and the secondary color is measured to detect density variations of yellow.

In more concrete terms, the colors to be overlapped with yellow are magenta which, when overlapped with yellow, produces red and cyan which, when overlapped with yellow, produces green. In this embodiment, cyan which generates green is taken as an example.

First, a predetermined print pattern is printed on the print medium with a cyan ink alone and read by a green optical sensor and, according to the read value, a density variation correction is executed. Then, as a base for a yellow print pattern, a cyan print pattern is printed on the print medium with a uniform density. Then a yellow print pattern, which is to be measured, is printed over the cyan base pattern. As a result, the print pattern actually printed on the print medium turns green. This green print pattern is illuminated with light from the green light emitting element to measure reflected light. A difference between the measured sensor output voltage and the reference is determined. Because the cyan pattern as a base is already subjected to the density variation correction and printed with a uniform density, the difference thus obtained concerns the yellow pattern. Therefore, according to this difference, the density variation correction processing, such as culling operation, is performed on the predetermined yellow nozzle or block as in the third embodiment.

As described above, even when the light emitting wavelength range of the light emitting element deviates from the light absorbance characteristic of the detection pattern, the detection pattern can be measured by using a secondary color, thus allowing the density variation correction. By reducing the number of light emitting elements it is possible to reduce the cost of wiring and also the size of the optical sensor itself.

[Fifth Embodiment]

Both of the third and fourth embodiments measure a print pattern by using an optical sensor incorporating a light emitting element that has a spectrum characteristic with a sufficient light absorbing capability. The print pattern of each color can also be measured by using a white light emitting element that has the spectrum characteristic over the entire visible light range. In the fifth embodiment we will describe a case where a white light emitting element is used as the light emitting element of the optical sensor.

Figure 38:
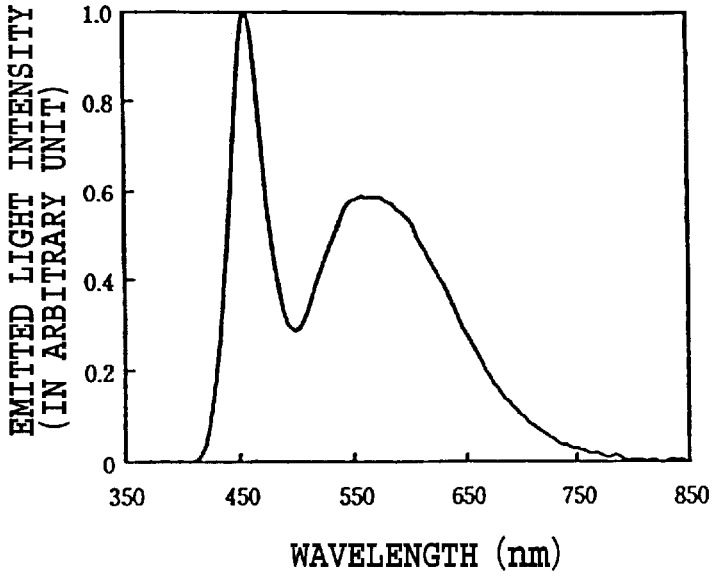
FIG. 38 is a graph showing a spectrum characteristic of a white LED.

FIG. 38 shows a spectrum characteristic of the optical sensor incorporating a white LED as the light emitting element. This white LED emits light over almost the entire visible light range and thus can provide a light absorbance characteristic for any of the colorants, black, cyan, magenta and yellow, used in this embodiment.

Therefore, the correction processing similar to that of the third embodiment can be performed by radiating light from this white LED to measure a sensor output voltage and determining a difference between the measured sensor output voltage and the reference.

By using a white light emitting element in this manner, it is possible to reduce the size of the optical sensor and the cost of wiring.

While the printing apparatus in the first to fifth embodiments described above have a plurality of print heads, this invention may use a single color print head.

Further, the printing system may be other than the ink jet system.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, according to the third to fifth embodiments of this invention, a pattern of a predetermined size is printed on the print medium with each corresponding nozzle or with each corresponding block consisting of a plurality of nozzles by using the density variation correction method. The optical sensor emits light against the pattern and the measuring means of the optical sensor measures an optical characteristic of reflected light. When a value measured by the measuring means exceeds the reference value, it is decided that the nozzle or nozzles in question are applying ink to the print medium in an amount greater than the appropriate amount. Then, a correction value is determined for that part of actual image data which needs to be printed by the nozzles of interest. Using an output γ correction table corresponding to the correction value, the density correction processing is carried out.

This makes it possible to detect density variations easily and automatically with high precision without using an expensive input device such as scanner and to perform the density variation correction according to the detected value.

Because a relatively inexpensive optical sensor is used, the overall cost of the printing apparatus can be kept low.

Instead of three RGB color light emitting elements, a white light emitting element can be used to further reduce the size of the optical sensor and the cost of wiring.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus for performing a printing operation with a print head having a plurality of print elements, comprising:

an optical sensor having a light emitting portion and a light receiving portion;

pattern forming means for printing on a print medium a plurality of predetermined patterns conforming to a light emitting wavelength range of said optical sensor, each of the plurality of patterns being formed by each corresponding print element or each corresponding block made up of a plurality of print elements;

measuring means for emitting light from the light emitting portion of said optical sensor against the patterns printed on the print medium by said pattern forming means and measuring optical characteristics of the plurality of patterns; and correction means for taking, as a reference density, a predetermined density obtained from the optical characteristics of each of the plurality of patterns, and calculating a ratio of a density of the patterns to the reference density to perform a correction process based upon the calculated ratio.

2. A printing apparatus according to claim 1, wherein said correction means has:

a plurality of output density correction tables used to correct, according to a density value of print data, an output density value of the print data to be printed by the corresponding print element or by the corresponding block made up of a plurality of print data; and output density correction table selection means for selecting from among the output density correction tables according to the optical characteristic of each pattern read by said optical sensor.

3. A printing apparatus according to claim 2, wherein said correction means further includes calculation means for detecting the lowest density from the optical characteristics of the measured patterns, taking the lowest density as a reference density and calculating a ratio of each pattern's density to the reference density, and said output density correction table selection means selects, based on the ratio calculated by said calculation means, an output density table for each block allocated to the corresponding pattern.

4. A printing apparatus according to claim 1, further including a calibration means for calibrating the light emitting portion or light receiving portion of said optical sensor according to the tone of the pattern.

5. A printing apparatus according to claim 4, wherein a drive signal supplied to a drive unit for driving the light emitting portion of said optical sensor can be modulated, and said calibration means performs calibration by modulating the drive signal.

6. A printing apparatus according to claim 1, wherein the light emitting portion of said optical sensor is a white LED.

7. A printing apparatus according to claim 1, wherein if the tone of a colorant forming the pattern has a wavelength that cannot be detected by said optical sensor, said pattern forming means forms a base with a colorant of a tone that can be detected by said optical sensor and then forms the pattern over the base with the colorant of the tone that cannot be detected by said optical sensor, and said measuring means measures the pattern of a secondary color formed by said pattern forming means.

8. A printing apparatus according to claim 1, wherein said optical sensor has a plurality of light emitting portions and light receiving portions with different wavelengths.

9. A printing apparatus according to claim 8, wherein the light emitting portions of said optical sensor are a green LED, a red LED and a blue LED.

10. A printing apparatus according to claim 1, wherein the print elements perform printing according to an ink jet system.

11. A printing apparatus according to claim 10, wherein said correction means adjusts the amount of ink ejected from the print elements according to a difference between the measured sensor output and the reference.

12. A printing apparatus according to claim 10, wherein the print elements generate a bubble in the ink by using thermal energy and eject an ink droplet by a pressure of the generated bubble.

13. A density variation correction method using a printing apparatus, the printing apparatus performing a printing operation by using a print head having a plurality of print elements, the correction method comprising:

a step of using an optical sensor having a light emitting portion and a light receiving portion;

a pattern forming step for printing on a print medium a plurality of predetermined patterns conforming to a light emitting wavelength range of said optical sensor, each of the plurality of patterns being formed by each corresponding print element or each corresponding block made up of a plurality of print elements;

a measuring step for emitting light from the light emitting portion of said optical sensor against the patterns printed on the print medium by the pattern forming step and measuring optical characteristics of the plurality of patterns; and a correction step for taking, as a reference density, a predetermined density obtained from the optical characteristics of each of the plurality of patterns, and calculating a ratio of a density of the patterns to the reference density to perform a correction process based upon the calculated ratio.

14. A density variation correction method according to claim 13, wherein said correction step has:

a plurality of output density correction tables used to correct, according to a density value of print data, an output density value of the print data to be printed by the corresponding print element or by the corresponding block made up of a plurality of print data; and an output density correction table selection step for selecting from among the output density correction tables according to the optical characteristic of each pattern read by said optical sensor.

15. A density variation correction method according to claim 14, wherein said correction step further includes a calculation step for detecting the lowest density from the optical characteristics of the measured patterns, taking the lowest density as a reference density and calculating a ratio of each pattern's density to the reference density, and said output density correction table selection step selects, based on the ratio calculated by a calculation means, an output density table for each block allocated to the corresponding pattern.

16. A density variation correction method according to claim 13, further including a calibration step for calibrating the light emitting portion or light receiving portion of said optical sensor according to the tone of the pattern.

17. A density variation correction method according to claim 16, wherein a drive signal supplied to a drive unit for driving the light emitting portion of said optical sensor can be modulated, and the calibration step performs calibration by modulating the drive signal.

18. A density variation correction method according to claim 13, wherein if the tone of a colorant forming the pattern has a wavelength that cannot be detected by said optical sensor, the pattern forming step forms a base with a colorant of a tone that can be detected by said optical sensor and then forms the pattern over the base with the colorant of the tone that cannot be detected by said optical sensor, and said measuring step measures the pattern of a secondary color formed by said pattern forming step.

19. A test pattern printing method for printing on a predetermined print medium a test pattern whose density is optically detected by a density sensor to obtain output characteristic information on a plurality of nozzles provided in a print unit mounted on said printing apparatus that reciprocates the print unit in a main scan direction and at the same time moves the print medium in a sub-scan direction crossing the main scan direction to perform printing on a predetermined area of the print medium, the test pattern printing method comprising the steps of:

dividing a nozzle array made up of a plurality of nozzles provided in the print unit into a plurality of nozzle blocks; and printing each of patches in a size and shape that enables the density of the patch to be optically detected by said density sensor by using only the nozzles of the same nozzle block allocated to the patch being printed;

wherein said test pattern comprises a plurality of patches.

20. A test pattern printing method according to claim 19, wherein the test pattern comprises forward printing patches formed by the corresponding nozzle blocks during a forward movement of the print unit and backward printing patches formed by the corresponding nozzle blocks during a backward movement of the print unit.

21. A test pattern printing method according to claim 19, wherein the test pattern comprises only forward printing patches formed by the corresponding nozzle blocks during a forward movement of the print unit.

22. A test pattern printing method according to claim 19, wherein the plurality of nozzle blocks each have the same number of nozzles.

23. A test pattern printing method according to claim 19, wherein the plurality of nozzle blocks have different numbers of nozzles.

24. A test pattern printing method according to claim 23, wherein only those of the plurality of nozzle blocks which are situated at ends of the print unit have smaller numbers of nozzles than other nozzle blocks.

25. A test pattern printing method according to claim 19, wherein the patches are formed by alternating a plurality of times a printing scan in the main scan direction with a movement of the print medium by a minimum width of the nozzle block, the single printing scan in the main scan direction being adapted to print a part of each of the plurality of patches on the print medium with the corresponding nozzle block.

26. An information processing apparatus for printing on a predetermined print medium a test pattern whose density is optically detected by a density sensor to obtain output characteristic information on a plurality of nozzles provided in a print unit mounted on a printing apparatus that reciprocates the print unit in a main scan direction and at the same time moves the print medium in a sub-scan direction crossing the main scan direction to perform printing on a predetermined area of the print medium, the information processing apparatus comprising:

a means for dividing a nozzle array made up of a plurality of nozzles provided in the print unit into a plurality of nozzle blocks; and a means for printing each of patches in a size and shape that enables the density of the patch to be optically detected by said density sensor by using only the nozzles of the same nozzle block allocated to the patch being printed;

wherein the test pattern comprises a plurality of patches.

27. An information processing apparatus according to claim 26, wherein the test pattern comprises forward printing patches formed by the corresponding nozzle blocks during a forward movement of the print unit and backward printing patches formed by the corresponding nozzle blocks during a backward movement of the print unit.

28. An information processing apparatus according to claim 26, wherein the test pattern comprises only forward printing patches formed by the corresponding nozzle blocks during a forward movement of the print unit.

29. An information processing apparatus according to claim 28, wherein the plurality of nozzle blocks each have the same number of nozzles.

30. An information processing apparatus according to claim 28, wherein the plurality of nozzle blocks have different numbers of nozzles.

31. An information processing apparatus according to claim 28, wherein only those of the plurality of nozzle blocks which are situated at ends of the print unit have smaller numbers of nozzles than other nozzle blocks.

32. An information processing apparatus according to claim 26, including:

a density sensor for optically reading a density of each patch of the test pattern;

an output density correction means having a plurality of output density correction tables, the output density correction tables being used to correct an output density value of print data according to a density value of the print data to be printed by the corresponding nozzle block; and an output density correction table selection means for selecting from among the output density correction tables according to the density of each patch read by said density sensor.

33. An information processing apparatus according to claim 32, wherein the density correction means has a calculation means for taking as a reference density the lowest of the patch densities read by said density sensor and calculating a ratio of each patch's density to the reference density, and the output density correction table selection means selects, based on the ratio calculated by said calculation means, an output density table for each nozzle block allocated to the corresponding patch.

34. An information processing apparatus according to claim 26, wherein the patches are formed by alternating a plurality of times a printing scan in the main scan direction with a movement of the print medium by a minimum width of the nozzle block, the single printing scan in the main scan direction being adapted to print a part of each of the plurality of patches on the print medium with the corresponding nozzle block.

35. A printing apparatus for printing on a predetermined print medium a test pattern whose density is optically detected by a density sensor to obtain output characteristic information on a plurality of nozzles provided in a print unit mounted on said printing apparatus that reciprocates the print unit in a main scan direction and at the same time moves the print medium in a sub-scan direction crossing the main scan direction to perform printing on a predetermined area of the print medium, said printing apparatus comprising:

a means for dividing a nozzle array made up of a plurality of nozzles provided in the print unit into a plurality of nozzle blocks; and a means for printing each of patches on the print medium by using only the nozzles of the same nozzle block allocated to the patch being printed;

wherein said test pattern comprises a plurality of patches.

36. A printing apparatus according to claim 35, wherein said test pattern comprises forward printing patches formed by the corresponding nozzle blocks during a forward movement of the print unit and backward printing patches formed by the corresponding nozzle blocks during a backward movement of the print unit.

37. A printing apparatus according to claim 35, wherein said test pattern comprises only forward printing patches formed by the corresponding nozzle blocks during a forward movement of the print unit.

38. A printing apparatus according to claim 35, wherein the plurality of nozzle blocks each have the same number of nozzles.

39. A printing apparatus according to claim 35, wherein the plurality of nozzle blocks have different numbers of nozzles.

40. A printing apparatus according to claim 39, wherein only those of the plurality of nozzle blocks which are situated at ends of the print unit have smaller numbers of nozzles than other nozzle blocks.

41. A printing apparatus according to claim 35, wherein the patches are formed by alternating a plurality of times a printing scan in the main scan direction with a movement of the print medium by a minimum width of the nozzle block, the single printing scan in the main scan direction being adapted to print a part of each of the plurality of patches on the print medium with the corresponding nozzle block.

42. A printing apparatus according to claim 35, wherein the print unit applies a thermal energy to ink to generate a bubble and ejects the ink by an energy generated by the bubble.

* * * * *

UNITED STATES PATENT AND TRADEMARK OFFICE

CERTIFICATE OF CORRECTION

PATENT NO. : 6,832,825 B1
DATED : December 21, 2004
INVENTOR(S) : Hitoshi Nishikori et al.

It is certified that error appears in the above-identified patent and that said Letters Patent is hereby corrected as shown below:

Column 2,
Line 27, “such” should read -- such as --;
Line 58, “dot.” should read -- dots. --; and
Line 59, “nozzle” should read -- nozzles --.

Column 6,
Line 18, “33E” should read -- 33D --.

Column 8,
Line 36, “a” should be deleted.

Column 11,
Line 54, “a” should read -- ∝ --.

Column 15,
Line 10, “each” should be deleted.

Column 16,
Line 48, “dot,” should read -- dots, --; and
Line 51, “nozzle” should read -- nozzles -- and “block” should read -- blocks --.

Column 21,
Line 9, “a” should read -- ∝ --.

Column 23,
Line 43, “consists” should read -- consist --.

Signed and Sealed this

Seventh Day of June, 2005

JON W. DUDAS
*Director of the United States Patent and Trademark Office*